United States Patent [19]

Wiseman

[11] 4,439,974

[45] Apr. 3, 1984

[54] GUIDE MECHANISM AND FINGER

[75] Inventor: John A. Wiseman, Lynchburg, Va.

[73] Assignee: Simplimatic Engineering Co., Lynchburg, Va.

[21] Appl. No.: 343,371

[22] Filed: Jan. 27, 1982

Related U.S. Application Data

[63] Continuation-in-part of Ser. No. 278,000, Jun. 26, 1981, and Ser. No. 309,671, Oct. 8, 1981, abandoned.

[51] Int. Cl.[3] ..... B65B 32/02; B65B 5/08

[52] U.S. Cl. ..... 53/248; 53/261

[58] Field of Search ..... 53/247–249, 53/261, 262

[56] References Cited

U.S. PATENT DOCUMENTS

| | | | |
|---|---|---|---|
| 3,911,647 | 10/1975 | Hartness | 53/248 |
| 4,248,028 | 2/1981 | Dardaine | 53/248 |
| 4,281,501 | 8/1981 | Rydell | 53/248 |
| 4,406,111 | 9/1983 | Raudat | 53/248 X |

*Primary Examiner*—A. J. Heinz

*Attorney, Agent, or Firm*—James & Franklin

[57] ABSTRACT

A guide mechanism for a case packer is characterized by a mounting member, a plurality of guide member fingers, and a plurality of expansion springs, each spring connecting a different finger to the mounting member and also biasing the bottom of the finger towards a converging position with the other finger bottoms. The springs act substantially vertically, enabling substantially unlimited universal pivoting of the fingers relative to the mounting member and thereby reducing the likelihood of finger breakage in the event of a jam.

46 Claims, 20 Drawing Figures

FIG-3
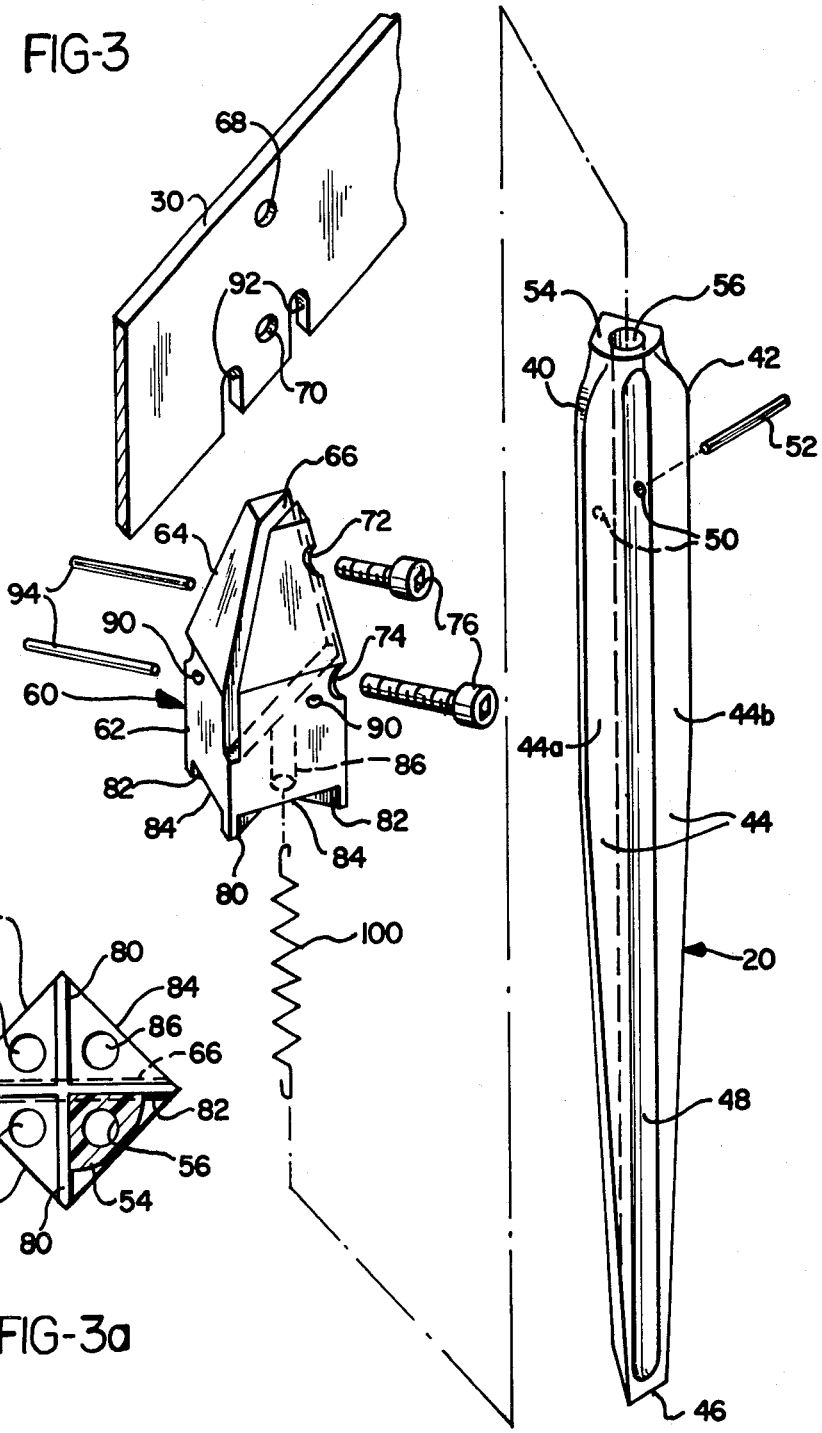
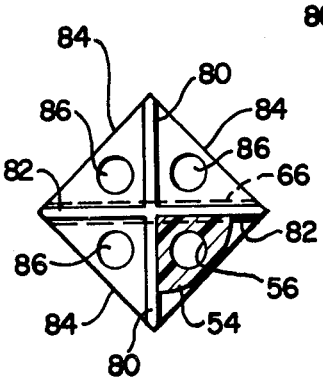
FIG-3a 32
30
64
64
94
94
62
86
86
62
92
92
82
56
56
82
80
80
E
100
52
48
20
44
102
102
E
46

GUIDE MECHANISM AND FINGER

RELATED APPLICATIONS

This application is a continuation-in-part of copending U.S. Ser. No. 278,000 filed June 26, 1981 and Ser. No. 309,671, filed Oct. 8, 1981 now abandoned.

BACKGROUND OF THE INVENTION

The present invention relates to an article loader and, more particularly, to a case packer of the type having a member mounted on a support to guide an article into a cell.

Case packers of the type herein under discussion normally include a bottle conveying apparatus, in the form of a conveyor belt or the like, designed to provide a continuous stream of bottles to a loading platform where the bottles are accumulated in the desired pattern. The bottles are fed to the top surface of a displaceable loading grid located in the loading platform. When the bottles are in the desired pattern, the loading grid is displaced, such that it no longer supports the bottles, and same drop into a waiting case.

A case or carton having a plurality of cells therein, formed by upstanding interlocking partitions, is positioned underneath the platform such that each cell therein is aligned with a different one of the bottles located on the platform. The case is then moved relative to the platform to reduce the distance therebetween. When the case is properly positioned relative to the loading platform, the bottles are released from the platform.

The partitions in the case are often not initially positioned correctly to form cells of the required dimensions. The misalignment of the partitions must be corrected if the bottles are to be inserted into the cells. Positioning of the partitions and guiding of the bottles therein is achieved by a guide mechanism interposed between the platform and the case. The guide mechanism positions the cell partitions such that same do not obstruct the paths through which the bottles move and, further, provides a funnel-type structure to guide the bottles into the cells.

As the case is moved relative to the guide mechanism, the guide members are inserted into the case and interact with the cell partitions to initially position same. After the guide members are fully inserted into the cell, the bottles are released. As the bottles pass through the guide mechanism, the weight of the bottles causes the guide members to move outwardly, causing the partitions to move all the way to their respective proper positions, such that the individual cells are of proper dimensions.

After each case is loaded, it is moved downwardly with respect to the guide mechanism and transferred to the output side of the case packer, such that it can be loaded on the pallet or the like for storage or shipment. At the same time, an empty case is conveyed to a position below the guide mechanism and is thereafter lifted into the loading position.

Conventional guide mechanisms include a grid of upstanding stationary supports with openings therein aligned with the cells in the case, such that the bottles, once released from the platform, can pass through the respective openings in the guide mechanism and into the cells. Because the upstanding partitions which form the cell walls are often initially misaligned with respect to each other, it is necessary that the guide mechanism serve to properly position the partitions to permit insertion of the bottles therein. If the partitions which form the cell walls are not properly positioned, the wall of the bottle, as same is dropped from the platform, may contact the edge of one of the partitions, either preventing the bottle from being inserted into the cell, or crushing the partition—which is normally made of relatively thin corrugated paperboard or the like. These conditions are intolerable because same may result in an improperly packed case and/or loose bottles which must be manually removed from the line.

In order to correct misalignment of the partitions which form the cell walls and to properly guide the bottles into the cells, guide members, commonly referred to as "fingers" because of their elongated structure, are mounted on the support grid such that they extend downwardly therefrom towards the case. The fingers are either flexible and fixedly mounted to the support grid, or rigid and pivotally mounted in a spring-loaded manner to the support grid, such that same are movable from a normally closed position to an open position as the bottle moves therebetween.

In most conventional guide mechanisms, for each cell in the case, four fingers are provided, each finger being mounted on the support grid such that it is aligned with a corner of the cell or one of the cell walls. However, in certain instances, it is possible to use only two fingers per cell, the fingers being positioned to align with opposite corners of the cell. This structure is fully disclosed in U.S. Pat. No. 4,171,603 issued Oct. 23, 1979 to John A. Wiseman, and entitled: "Guide Mechanism For Loading Wide-Mouth Bottles In Cases", to which the reader is referred.

When rigid members or fingers are utilized, as disclosed in the above-mentioned patent in one form, and in many other prior art devices embodying other forms, same are spring loaded towards a closed position, wherein the guide members or fingers converge and are downwardly and inwardly inclined such that the peripheral edges of the extreme lower section of each of the guide members or fingers is in proximity to, in engagement with, or in overlapping relationship with the peripheral edges of the extreme lower sections of the adjacent members, so as to form a generally conical or wedge-shaped tip structure.

As the case is moved relative to the guide mechanism, immediately prior to loading of the bottles therein, the tip formed by the convergence of the lower sections of the guide members is first received into the aligned cell. As the converged members are received deeper and deeper into the cell, misalignment of the partitions which form the cell walls is gradually partially corrected by straightening the partitions such that the partitions will not obstruct the path of the incoming bottle. The bottles are then released from the platform and dropped between the converged guide members or fingers. The guide members or fingers, still in the closed position, act to guide the bottle into the cell in funnel-like fashion.

As the bottle travels down the fingers, the fingers are moved apart by the bottle until they are in an opened, substantially vertical position, thereby serving to guide the bottle into the cell, while further opening the partitions. In the opened position, the fingers are substantially parallel to the cell walls. After the case is loaded, the case is moved downwardly relative to the guide mechanism, withdrawing the fingers from the cell and, thereafter, the loaded case is removed from the case packer. Once the fingers clear the case, they are spring loaded to return to the closed position—ready to guide the next set of bottles into a case.

Thus, the fingers must be mounted on the support grid in a manner such that they normally assume the closed position, but may be pivoted by an article, as same is loaded into a cell, to an opened position. A variety of different structures for movably mounting the rigid guide fingers to the support grid have been devised.

However none of these mounting structures has proven to be entirely satisfactory in use. A disadvantage of the early prior art mounting structures was that the resilient means, used to bias the fingers towards the closed position, was not disposed in a protected position so that when a jam did occur, the resilient means became damaged either directly by the jam or indirectly as a result of the efforts required to clear the jam. In an effort to protect the resilient means urging the fingers to their closed position against damage by articles dropping through the passage, many of the more recent prior art mounting structures position the resilient means far from the passage. For example, some employ a circular or garter coil tension spring mounted atop a mounting member to bias simultaneously a plurality of fingers on that mounting member, while others employ a leaf spring depending from the mounting member, each leaf spring acting on the rear of an associated finger. However, after frequent intermittent stretching and retracting, circular tension springs may lose part of their resiliency and thus not be capable of suitably positioning and biasing the fingers. Similarly, after frequent intermittent flexing, spring steel leaf springs may lose their memory and thus not be capable of returning the fingers to their original closed position. A characteristic disadvantage of many prior art mounting structures is that repair or replacement of parts is a complicated and time-consuming process. A further disadvantage of many prior art mounting structures is the limitations which they place upon the pivotal movement of the fingers relative to the mounting structure. As a result, when a jam occurs in the articles being loaded into the case, the fingers are not capable of accommodating in all directions necessary and to the extent necessary; thus the fingers become twisted or broken, requiring downtime for replacement.

Accordingly, it is an object of the present invention to provide a guide mechanism for a case packer or the like which enables the fingers essentially unlimited universal pivotal movement about the mounting structure, thereby to reduce finger breakage.

Another object is to provide such a guide mechanism which employs a resilient means (other than a garter spring or leaf spring) both to connect the finger to the mounting structure and to cooperate with the top of the finger and the bottom of the mounting structure to bias the finger to its closed position.

Yet another object of the present invention is to provide such a guide mechanism in which repair and replacement of the parts is facilitated generally and, more specifically, a single finger or finger/spring subassembly or block/finger/resilient means subassembly may be replaced without disassembly of other portions of the guide mechanism.

A further object is to provide such a guide mechanism in which the resilient means are disposed closely adjacent the articles as they pass through the passage yet are protected from damage thereby.

The present invention also has as its object the provision of a finger suitable for use in such a guide mechanism.

SUMMARY OF THE INVENTION

It has now been found that the above and related objects of the present invention are obtained in a guide mechanism for use in an article-loading machine (e.g., a case packer) having means for positioning articles in predetermined juxtaposition above the guide mechanism and means for positioning an article-receiving receptacle below the guide mechanism. The guide mechanism comprises a plurality of elongated support members defining a generally horizontal grid and a plurality of mounting members spaced along the support members to define passage through which the articles pass downwardly into the receptacle. The guide mechanism is characterized by elongated downwardly-extending rigid guide member fingers and resilient means connecting the mounting members and the fingers and acting substantially vertically to force pivotal engagement of the tops of the fingers and the bottoms of the mounting members. The finger tops, mounting member bottoms and resilient means cooperate to define a fulcrum so that the lower ends of the fingers extend inwardly towards the centers of the passages for engaging articles before the articles are dropped through the passages and pivot outwardly towards the corners of the passages as the articles pass through the passages into the receptacle.

Generally the fingers are disposed adjacent the corners of the passages and connected to the mounting members by, and only by, the resilient means. The finger tops, mounting member bottoms and resilient means are configured and dimensioned to permit essentially unlimited universal pivoting of the fingers relative to the mounting members, thereby to reduce breakage of the fingers.

Each resilient means comprises an expansion spring secured adjacent one end to one of the mounting members and adjacent the other end to one of the fingers, preferably at a point appreciably spaced downwardly from the top of such finger, the spring extending substantially vertically prior to the dropping of articles into the passages. Thus the resilient means avoids the disadvantages associated with the circular or garter spring which tends to lose its resiliency and the leaf spring which tends to lose its memory. Furthermore as the fingers are connected to the mounting members only by the tension spring, the fingers are easily and swiftly removable from the mounting members, individually and with the use of nothing other than needle nose pliers.

Each of the mounting members preferably includes on the lower surface thereof a plurality of downwardly extending ridges defining a plurality of separate and distinct bottom-defining compartments. The ridges limit sliding of each of the fingers associated with a given one of the mounting members towards other of the fingers associated with the same mounting member, while enabling essentially unlimited universal pivotal movement of the fingers relative to the same mounting member. In a preferred embodiment the bottoms defined by the mounting member compartments are larger than the tops of the fingers, each mounting member including a pair of intersecting ridges to define four triangular compartments, with the resilient means entering into the mounting member substantially through the centers of the compartments.

Typically the tops of the fingers, the bottoms of the mounting members or both are inclined at other than 90° relative to the axis of the fingers, thereby to incline the lower ends of the fingers inwardly towards the center of the passages.

Each of the fingers defines an axially extending recess exposed to an associated of one of the passages, with the resilient means extending an appreciable length into the recess so that the recess protects the resilient means from damage. Preferably the top of the finger includes a surface defining an aperture leading to the recess, and the resilient means enters the recess by the aperture so that the aperture assists in maintaining the resilient means within the recess even as the finger is twisted. The recess is configured and dimensioned to receive therein a substantial portion of the resilient means.

If desired, the guide mechanism may also incorporate connector means adapted for connection at one end to the spring or resilient means and at the other end to the fingers, thereby to secure the fingers to the mounting members and enable the effective length of the spring to be varied by the use of appropriately sized connector means without removal of the spring from the mounting member.

In a second preferred embodiment of the present invention, at least one of the mounting members is comprised of two half-members disposed on opposite sides of one of the support members. Each half-member has a lower surface disposed above the bottom of the one support member, whereby the lower surface of the one support member limits sliding of each of the fingers associated with the other of the half-members, while enabling essentially unlimited universal pivotal movement of the fingers relative to the one mounting member.

A guide member suitable for use in the guide mechanism of the first and second embodiments of the present invention comprises an elongated rigid finger defining an aperture at the top thereof, an axially extending recess operatively communicating with the aperture, and means disposed within the recess for securing the resilient means to the finger at a point substantially spaced below the aperture. The finger is adapted to be connected by one of the resilient means to the finger at a point substantially spaced below the aperture. The finger is adapted to be connected by one of the resilient means to one of the mounting members with the resilient means acting substantially vertically to force pivotal engagement of the top of the finger and the bottom of the mounting member, so that the finger extends downwardly and the lower end of the finger extends inwardly towards the center of one of the passages for engaging an article before the article is dropped through the one passage into the receptacle and pivots outwardly towards a corner of the one passage as the article passes through the passage into the receptacle.

In a third preferred embodiment of the present invention, each of the mounting members comprises a keeper and a block, the keepers engaging upper portions of the support members and the blocks engaging lower portions of the support members and defining the mounting member bottoms. Each of the resilient means extends from below to above the blocks and operatively connects one of the fingers below and one of the keepers above, whereby operatively disconnecting the resilient means associated with the one finger from the one keeper enables disengagement of the finger from the keepers, the blocks and the support members.

In this third embodiment, preferably the blocks define generally vertically extending apertures therethrough, and the resilient means extend through the block apertures. Each of the resilient means is permanently secured adjacent one end (the lower end) thereof to a respective associated one of the fingers, whereby the resilient means and the associated one finger comprises a subcombination replacement unit. Each of the resilient means has the other end thereof (the upper end) adapted to removably engage an associated one of the keepers. (Alternatively, a generally U-shaped member having a hook at each end may be mounted on the one keeper with the hooks engaging two of the resilient means, respectively.) Upper portions of the resilient means are disposed above the tops of the blocks substantially in corners defined jointly by the keepers and the support members. It will be appreciated that the resilient means operatively connects the keepers and the fingers under tension and thereby also secures the keepers to the support member upper portions and the blocks to both the support member lower portions and the finger tops. Moreover, the resilient means normally maintains the fingers, keepers, blocks and support members together so that operative disconnection of all of the resilient means from a given one of the keepers enables disengagement from one another of the given keeper and all of the support members, blocks and fingers associated with the given keeper.

In this embodiment preferably the support members define notches at the top and bottom thereof, the top and bottom notches being adapted to receive the keepers and the blocks, respectively, and limit horizontal movement of each. The top of each block contains a pair of intersecting slots, one of the slots receiving a bottom portion of one of the support members therein and the other of the slots receiving the bottom portion of one of the keepers therein. The keepers extend outwardly from the plane of the support members at least substantially as far as the blocks, thereby to deflect falling articles from the tops of the blocks.

A guide member suitable for use in the guide mechanism of the third embodiment of the present invention comprises an elongated rigid finger defining an aperture at the top thereof and an axially extending recess operatively communicating with the aperture. The guide member further comprises resilient means at least partially disposed within the recess and adapted to be secured to one of the mounting members and means securing the resilient means to the finger at a point substantially spaced below the aperture. The finger is adapted to be operatively connected by the resilient means to the one mounting member with the resilient means acting substantially vertically to force pivotal engagement of the top of the finger and the bottom of the one mounting member so that the finger extends downwardly and the lower end of the finger extends inwardly towards the center of one of the passages for engaging an article before the article is dropped through the one passage into the receptacle and pivots outwardly towards a corner of the one passage as the article passes through the passage into the receptacle. Preferably the mounting member comprises a keeper and a block, the keepers engaging upper portions of the support members and the blocks engaging lower portions of the support members, the blocks having generally vertically extending apertures therethrough. The resilient means is configured and dimensioned to enable passage thereof upwardly through one of the block apertures and operative connection thereof to one of the keepers, the resilient means thereby acting to maintain a finger and its associated block, keeper and support member in appropriate juxtaposition.

In a fourth preferred embodiment of the present invention, the guide mechanism is similar to that of the third embodiment except that each of the resilient means extending from below to above the blocks operatively connects an associated pair of the fingers below and an associated one of the keepers above. Preferably the resilient means comprises a resilient belting having end portions thereof extending through the associated block and secured to the associated pair of fingers and a bight portion intermediate the end portions stretched over the keeper.

Generally each of the resilient means passes through a respective block, is removably connected to a respective given keeper thereabove and is secured to at least two of the fingers associated with the given keeper therebelow, whereby operatively disconnecting all of the resilient means secured to the given keeper from the given keeper enables disengagement of the respective block, the resilient means and the fingers associated with the given keeper, as a subcombination replacement unit, from the given keeper and the support members. Typically the resilient means has opposite end portions secured to different fingers, the end portions being operatively disconnectable from the fingers and capable of passing through the associated block, thereby to enable disengagement from each other of the associated block, the fingers, and the resilient means. The blocks define at least a pair of generally vertically extending apertures therethrough, and each of the resilient means extends through an associated pair of the block apertures disposed to one side of the associated support member.

A guide member suitable for use in the guide mechanism of the fourth embodiment of the present invention is identical to the guide members suitable for use in the first and second embodiments, as described hereinabove.

BRIEF DESCRIPTION OF THE DRAWING

FIG. 3 is an exploded isometric view of the guide mechanism;

FIG. 3A is a bottom plan view of the mounting member by itself with a single top portion of a guide member being shown in cross section for reference purposes;

DETAILED DESCRIPTION OF THE PREFERRED EMBODIMENTS

Figure 1:
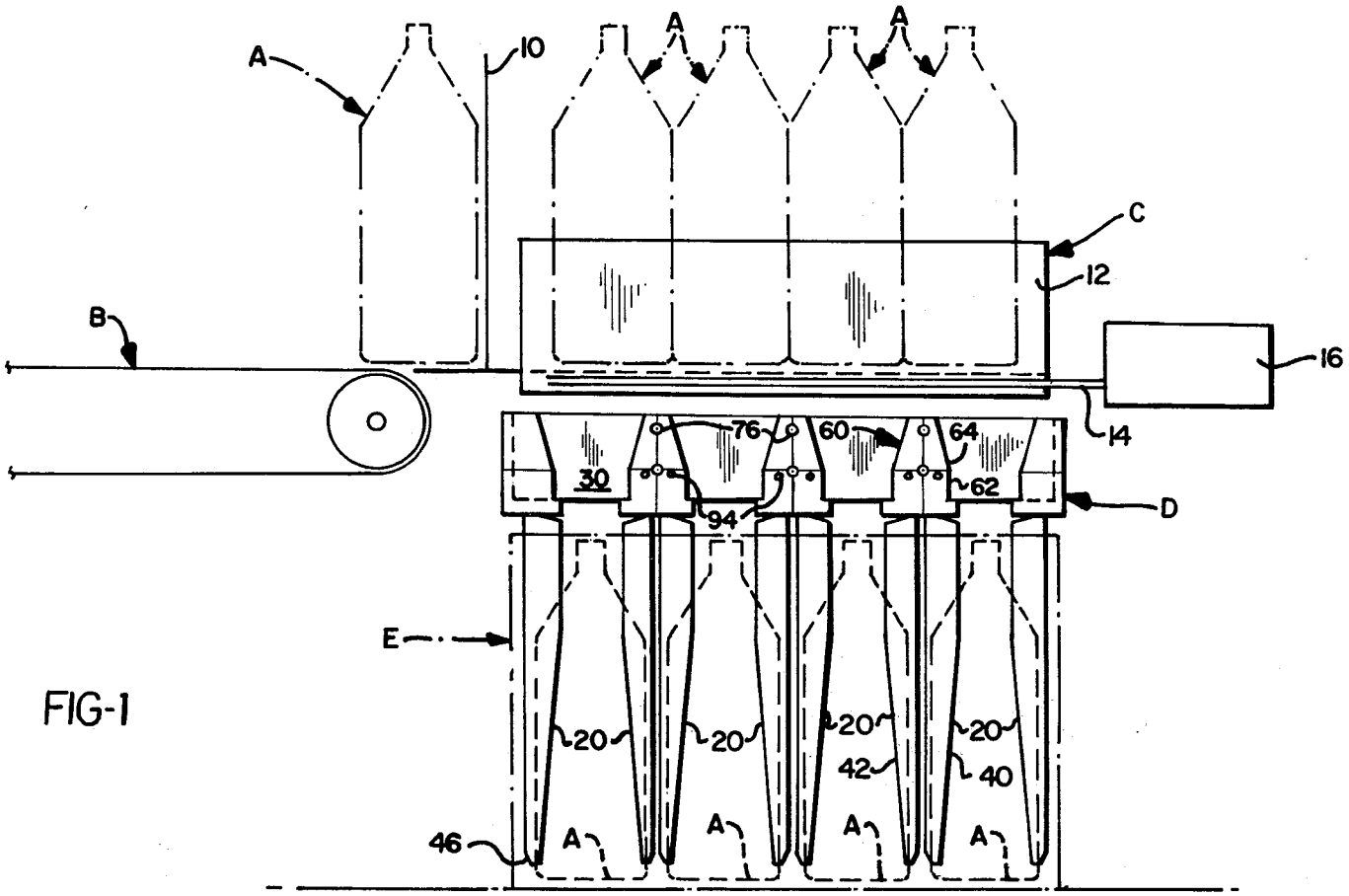
FIG. 1 is a side elevation view showing a portion of a case packer employing the guide mechanism of the present invention, the bottles and carbon being shown in phantom line.

As seen in FIG. 1, a plurality of articles, generally designated A, such as jars, bottles or the like, are conveyed by means of a conveyor, generally designated B, to a loading platform, generally designated C. A movable gate 10 is interposed between the output side of conveyor B and the input side of loading platform C so as to prevent additional articles A from entering platform C after platform C has received its full compliment of articles.

Platform C comprises three upstanding closed sides 12, and a fourth open side (leftmost as seen in FIG. 1), constituting the entrance to platform C. The bottom or floor of platform C is also open, except for a displaceable grid 14 which is movable, by a conventional drive mechanism 16, between a first position, wherein the articles A in platform C are supported, and a second position, wherein the articles A in platform C are permitted to move, by means of gravity, through the bottom of the platform.

Located immediately below platform C is the guide mechanism, generally designated D. Guide mechanism D comprises an upstanding support grid 18, a plurality of downwardly extending elongated guide members or fingers 20, and a means for movably mounting the guide fingers 20 to the support grid 18.

Below guide mechanism D is a case feed conveyor (not shown) which serves to feed cases, generally designated E, one at a time, into alignment beneath guide mechanism D. Also provided is an elevator or lift mechanism (not shown) for moving a case E in a vertical direction upwards towards guide mechanism D until the case E is in the position shown in FIG. 1. It should be noted that FIG. 1 shows the apparatus with the fingers 20 still situated in a loaded case, before the case is moved downwardly. However, the platform C is already loaded with the next set of articles.

Figure 2:
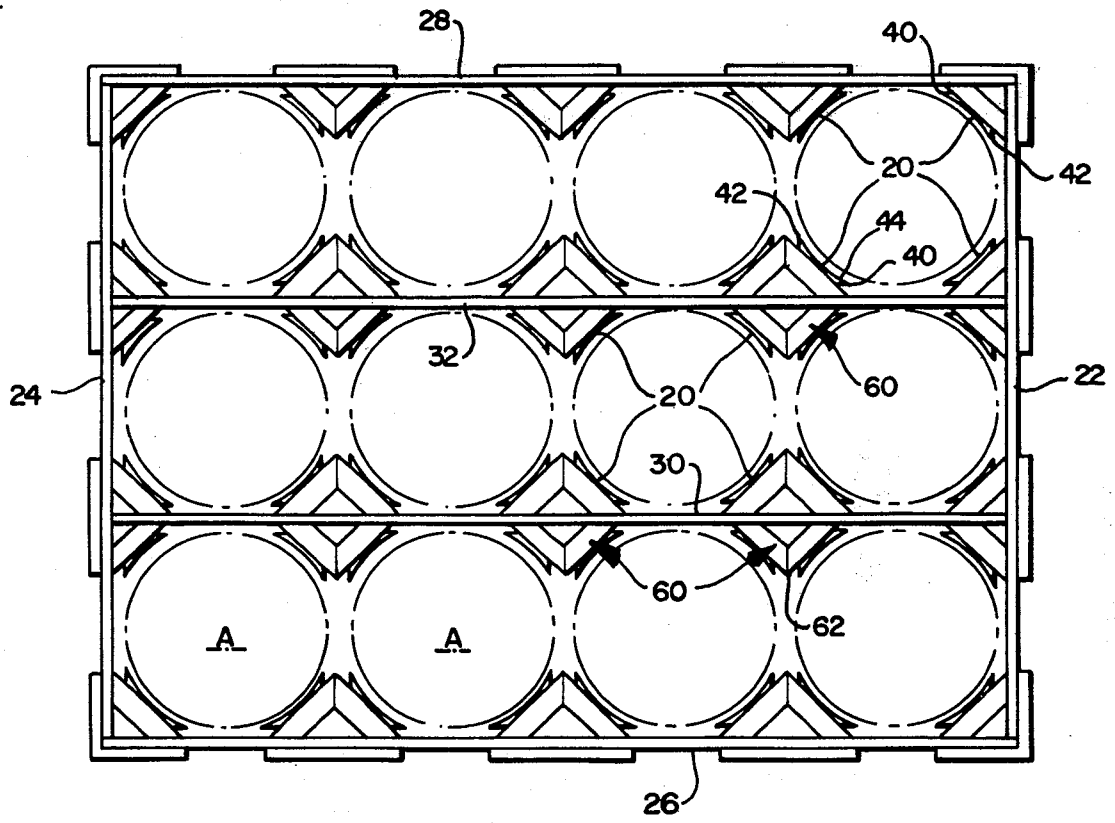
FIG. 2 is a top plan view, to an enlarged scale, of the guide mechanism of FIG. 1.

The structure of the support grid 18 of guide mechanism D can be seen in FIG. 2. The support grid 18 comprises first and second upstanding planar side support members 22, 24, a front planar upstanding member 26, a rear planar upstanding member 28, and a pair of intermediate upstanding planar members 30 and 32. The support grid illustrated in FIG. 2 is designed for use with a case having partitions dividing it into twelve cells, each of which receives a single article A therein. For each cell in the case, four guide members or fingers 20 are provided, each of which is aligned with a corner of the cell.

The body portion of each of the guide members 20 is structured to fit between an article A, having a circular cross-section, and a corner of the cell, when same is fully inserted into the case. The body portion of each of the guide members 20 has three sides or walls. The rear walls 40, 42 are substantially planar in configuration and situated at substantially right angles with each other so as to fit snugly into the corner of the cell. The front wall 44 has a concave curvature which approximates the curvature of the wall of article A and is designed so as not to obstruct the path of the article as the same is received in the cell.

Referring now to FIG. 3 which shows the guide mechanism structure in detail, surfaces 40, 42 and 44 of each guide member 20 are tapered at the bottom of the guide member 20 so as to form a tip 46 to facilitate insertion thereof between grossly misaligned case partitions. The front surface 44 defines a rather deep recess 48 extending almost the entire length thereof. As the recess 48 in effect divides the front wall 44 into two separate half-front walls 44*a*, 44*b*, the front wall 44 need not actually be curved as long as the half-front walls 44*a* and 44*b* are set at an angle to one another so that, taken as a whole, they operate as the aforementioned nonobstructing curved surface.

At a point spaced substantially below the top of the guide member 20 (for example, about 3½ centimeters from the top of a 24 centimeter long guide member), a small straight aperture 50 extends through both rear walls 40, 42 and the intervening recess 48. A rod or dowel 52 is friction-fitted into the aperture 50.

The upper end of the guide member 20 is beveled upwardly from the front wall 44 to the rear walls 40, 42 at an angle of appoximately 6 degrees, the precise angle being determined by that necessary to cause the guide members entering a cell to form a point, as explained hereinafter. The top guide member portion 54 defines an aperture 56 communicating with the recess 48, the radius of the aperture 56 preferably being approximately the radius of curvature of recess 48.

Still referring now in particular to FIG. 3, each mounting member, generally designated 60, comprises a generally square lower portion 62 and an upper portion 64 defined by four upwardly and inwardly sloping planar surfaces. Mounting member 60 is provided with a deep slit 66 extending from the top of the upper portion 64 approximately halfway into the lower portion 62, thereby enabling a mounting member 60 to be fitted from below onto a support member 30, 32. The support members 30, 32 are provided with a pair of vertically aligned apertures 68, 70, and the mounting member 60 is provided with a pair of similarly vertically spaced aligned apertures 72, 74, aperture 72 passing through the upper portion 64 and aperture 74 passing through the lower portion 62. Thus when the mounting member 60 is fitted onto the support member 30, 32 so that the bottom of the support member rests on the bottom of the slit 66, aperture 68 and 72, 70 and 74 are aligned and the mounting member 60 may be secured to the support member by appropriate screws 76. It will be appreciated that the downwardly and outwardly inclined surfaces of the upper mounting member portion 64 assist in deflecting erroneously directed articles off its center and into appropriate position for transmittal through the passages leading to the receiving cells.

A pair of diagonally disposed, downwardly extending intersecting ridges 80, 82 divide the bottom of the lower mounting member portion 62 into four separate and distinct compartments 84, the bottom of each compartment being essentially horizontal. The bottom of each compartment 84 is appreciably larger than the upper portion 54 of the guide member 20 with which it will be associated, the ridges 80, 82 acting to limit both sliding of each of the guide members 20 towards the other guide members associated with the same mounting member 60 and rotation of the guide member 20 away from its original orientation. The ridges 80, 82 preferably depend from the bottom of the lower mounting member portion 62 no further than is necessary to accomplish this end (generally only a few millimeters being required), so that they do not otherwise restrict movement of the guide member 20 relative to the compartment 84. Extending upwardly from the center of each compartment 84 through the lower mounting member portion 62 and stopping just short of the upper mounting member portion 64 is a cylindrical aperture 86.

On either side of the aperture 74 in the lower mounting member portion 62 and adjacent the bottom of that aperture 74 is a small aperture 90. Each small aperture 90 passes through a pair of the cylindrical apertures 86 disposed to one side of the ridge 82. The support members 30, 32 are provided with suitable slots 92 so that, when the mounting member 60 is in place upon the support member 30, 32, the small apertures 90 are aligned with the slots 92 and the dowels or rods 94 can be inserted, via slots 92, through the mounting member 60.

While it is possible to use the mounting members 60 as described above in all locations of the guiding mechanism where any portion of the mounting member 60 is required, for aesthetic reasons it may be desirable to utilize modified mounting members along the perimeter of the guide mechanism—that is, as the mounting members attached to support members 22, 24, 26 and 28. In this instance, as shown in FIG. 2, it may be desirable to use modified mounting members defining only a single compartment for the corners and modified mounting members defining only a pair of laterally adjacent compartments at other positions along the periphery. As the design of such modifications would be readily apparent to those skilled in the art from the description of the full mounting member 60 above, the details of such modified mounting members will not be set forth in detail herein.

The guide member 20 is secured to the mounting member 60 by means of, and only by means of, a rugged straight coil expansion spring 100 having an upper end extending through the cylindrical aperture 86 and being hooked around the rod or dowel 94 passing therethrough and a lower end extending through the guide member aperture 56 into the recess 48 and having that end hooked around the dowel or rod 52. To facilitate engagement of the upper end of spring 100 and rod 94, the upper end of spring 100 is generally appropriately disposed within the cylindrical aperture 86 prior to passage of the rod 94 therethrough. The lower end of spring 100 is easily passed through the aperture 56 and fastened about the rod 52 using a needle nosed pliers although, if desired, rod 52 can be inserted into aperture 50 after the lower end of spring 100 has been passed through aperture 56 and appropriately disposed within recess 48. Thus replacement of the guide member 20 requires only the use of a pair of needle nosed pliers and is accomplished without any interference with the operation of the other guide members 20 appended to the same mounting member 60.

It should be appreciated that the unique substantially vertical action of the resilient means in forcing pivotal engagement of the tops of the guide members and the bottoms of the mounting members is not dependent upon one end of the spring 100 engaging a rod 94 and the other end engaging a rod 52. Thus alternative means may be employed to secure the upper end of the spring 100 within the aperture 86 and the lower end of spring 100 within recess 48 of the guide member 20; for example, the lower end of spring 100 may be directly hooked onto an aperture extending from the recess 48 to the back of the guide member 20.

The cylindrical aperture 86 within the mounting member 60 as well as the aperture 56 and recess 48 of guide member 20 are of a size sufficient, relative to the spring 100, to avoid any spring binding problems. Additionally this enables most of the spring 100 below the level of the aperture 56 to lie protected within the recess 48, with only a small portion thereof exposed to the articles traversing the passage. The spring 100 is of appropriate length so that there is little extension thereof in either of the usual positions of the guide member 20, and there is sufficient room for extension to enble substantially unlimited universal pivotal movement of the guide member 20 relative to the mounting member 60. As clearly illustrated in FIG. 3*a*, the top surface of the guide member 20 is sufficiently smaller than the bottom of the compartment 84 so that the spring can permit sliding movement of the head 56 relative to the compartment bottom within the confines determined by the ridges 80, 82, which confines preclude sliding of the top portion 56 into the compartments of adjacent guide members 20 as well as undesirable guide member rotation. Obviously springs 100 of differing diameters may be used to accommodate different sized mounting members 20, and the spring tensions can be reduced to facilitate passage of light articles such as empty bottles and increased to slow the passage of heavy articles and decrease the impact with which they hit the bottom of the cell.

In the guide mechanism of the present invention there is little chance that the guide members 20 will ever be broken in a jam as each individual guide member can be moved in any direction (i.e., universal movement relative to the mounting member) until it is 90° to the vertical (i.e., substantially unlimited movement) and, when released, will snap back to its original position without any damage. Indeed, a group of four guide members fixed to the same mounting member 60 may be moved even beyond the 45° angle to the vertical and, when released, will snap back to their original position without any damage. This is in sharp contrast to many of the prior art guide mechanisms wherein mounting members tended to break upon lateral movement of any consequence.

It will be appreciated that, in the embodiment illustrated, as the bottom of compartment 84 is horizontal, the slope of the upper surface 54 of the mounting member 20 determines the at rest converging inclination assumed by the guide member and hence the point of convergence between the various guide members within a cell. However, in other embodiments the bottoms of compartments 84 may deviate from the horizontal and the mounting member top 54 may or may not be horizontal, thus the angle assumed by a guide member is a function of the interaction of the angles on the compartment bottoms of the mounting member and on the tops of the guide members.

Figure 4:
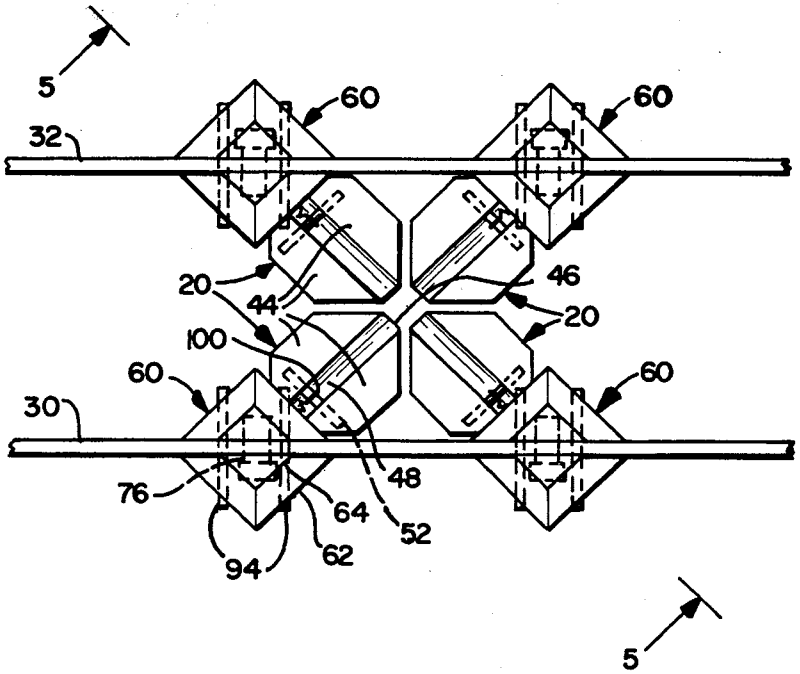
FIG. 4 is a top plan view showing a section of the guide mechanism with the guide members in their normal or converging position.
Figure 5:
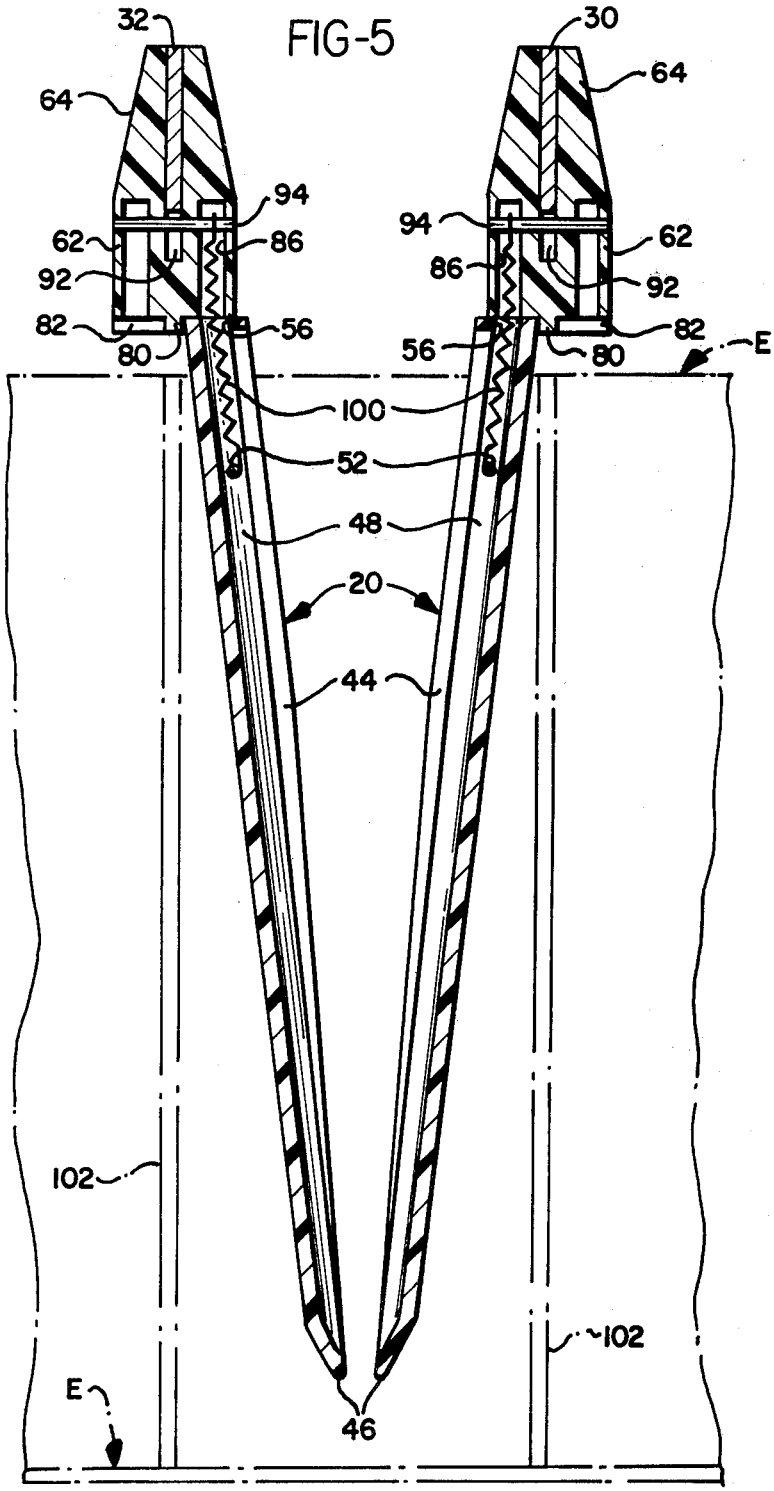
FIG. 5 is an elevation view of the section, as seen along line 5—5 of FIG. 4.

FIGS. 4 and 5 show guide members 20 in their normal or extended positions, wherein tips 46 are close to each other so as to form a wedge-type assembly to facilitate insertion of the member 20 between the case partitions 102 (shown in phantom line in FIG. 5). Springs 100, forcing engagement between the bottoms of the mounting member compartments 84 and the guide member upper surfaces 54, maintain the lower portions of the guide members 20 inclined toward the passages.

Figure 6:
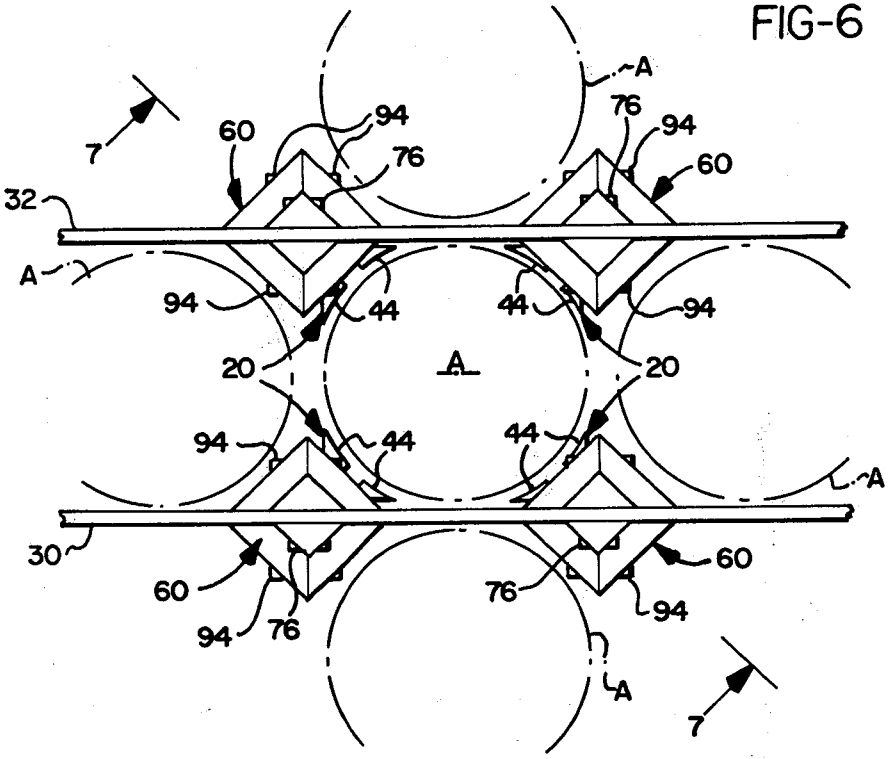
FIG. 6 is a top plan view, similar to that shown in FIG. 4, showing the guide members in their vertical or extended position.
Figure 7:
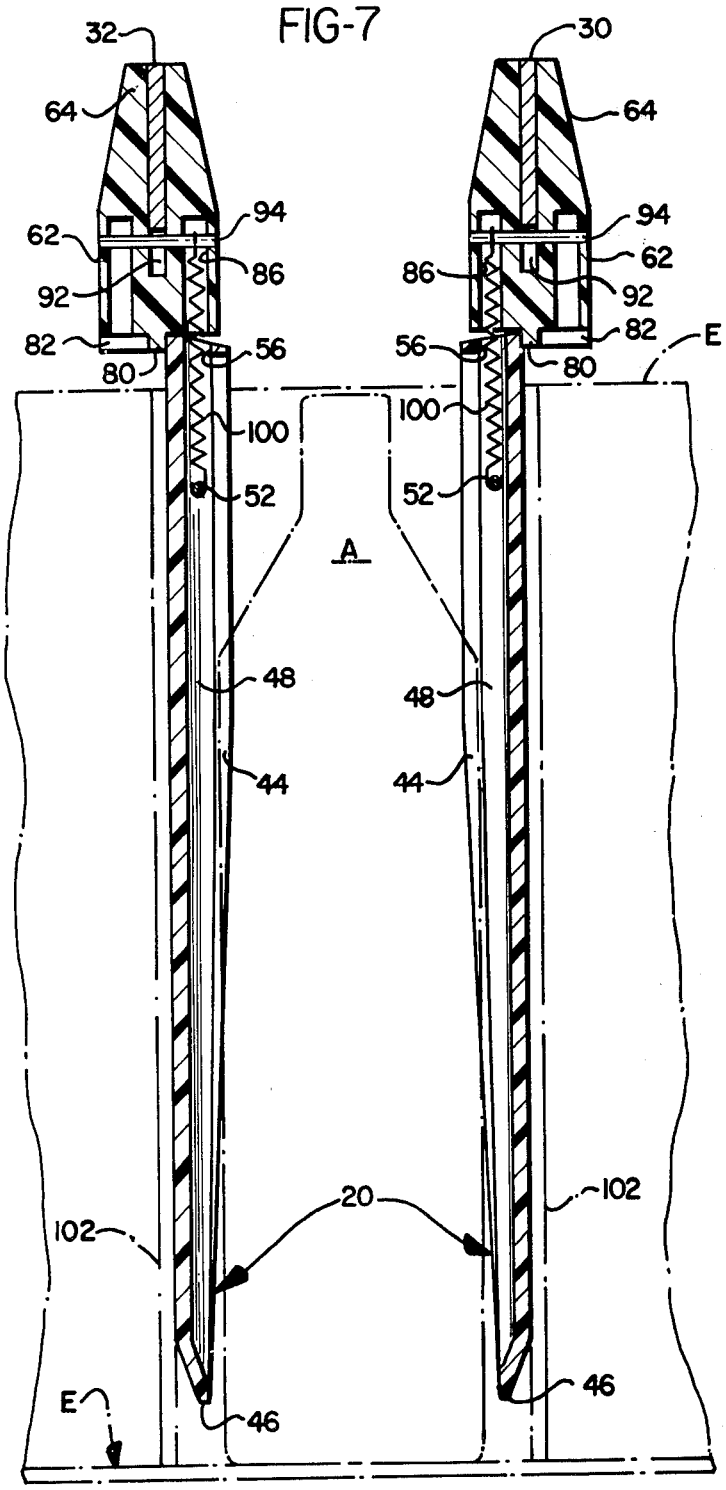
FIG. 7 is an elevation view of the section, as seen along line 7—7 of FIG. 6.

FIGS. 6 and 7 show that when an article A is dropped from platform C into the cells in case E, the guide members 20 about a passage are spread out from their normal or extended positions, as shown in FIGS. 4 and 5, and are moved outwardly into the corners of the cell formed by the case partitions 102. This causes the partitions to straighten out such that the article A can be properly inserted into the cell. As the lower portion of the guide members 20 move toward the vertical position, as seen at FIG. 7, the springs 100 become slightly stretched.

When case E is moved downwardly with respect to platform C, such that guide members 20 are extracted from the loaded cells therein, the action of springs 100 causes the guide members 20 to return to the position wherein the upper surfaces 54 thereof rest flatly against the bottoms of compartments 84. Thus, the action of springs 100 causes the guide members 20 to revert to their normal or extended position. At this point, as shown in FIG. 5, the springs 100 are less stretched and more bent, but still substantially vertical (although not as vertical as in their unbent condition, as shown in FIG. 7).

Figures 8, 8A:
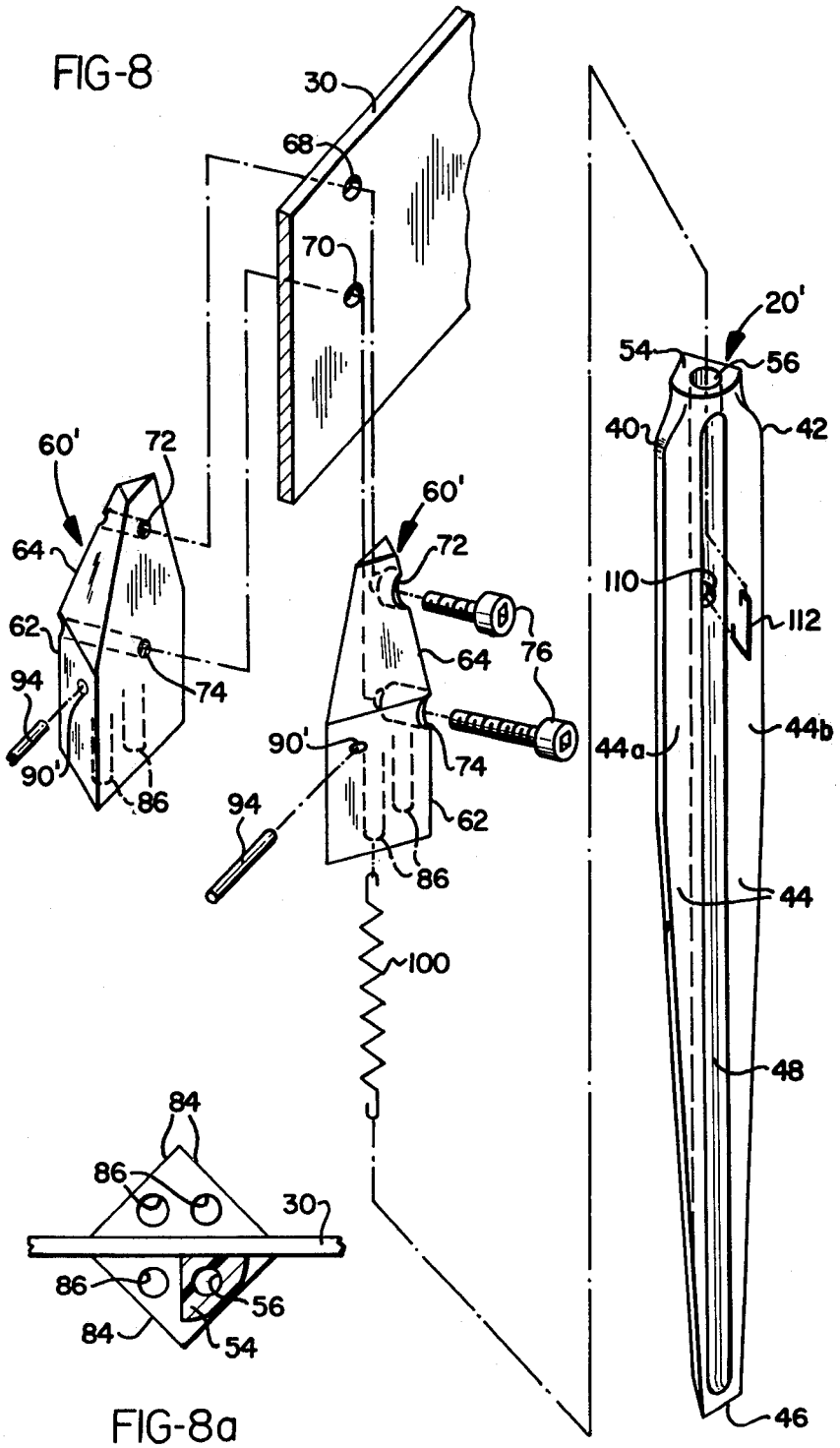
FIG. 8 is an exploded isometric view of a second embodiment of the guide mechanism.
FIG. 8A is a bottom plan view of the mounting member of the second embodiment by itself with a single top portion of a guide member being shown in cross section for reference purposes.
Figure 9:
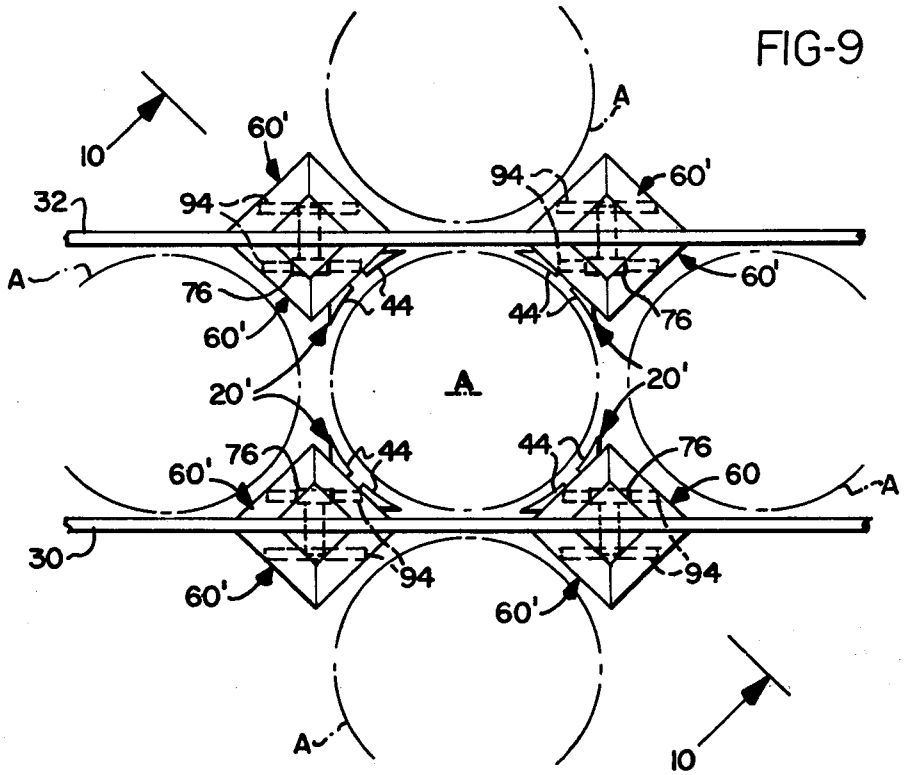
FIG. 9 is a top plan view of the second embodiment similar to that shown in FIG. 6 and showing the guide members in their vertical or extended position.
Figure 10:
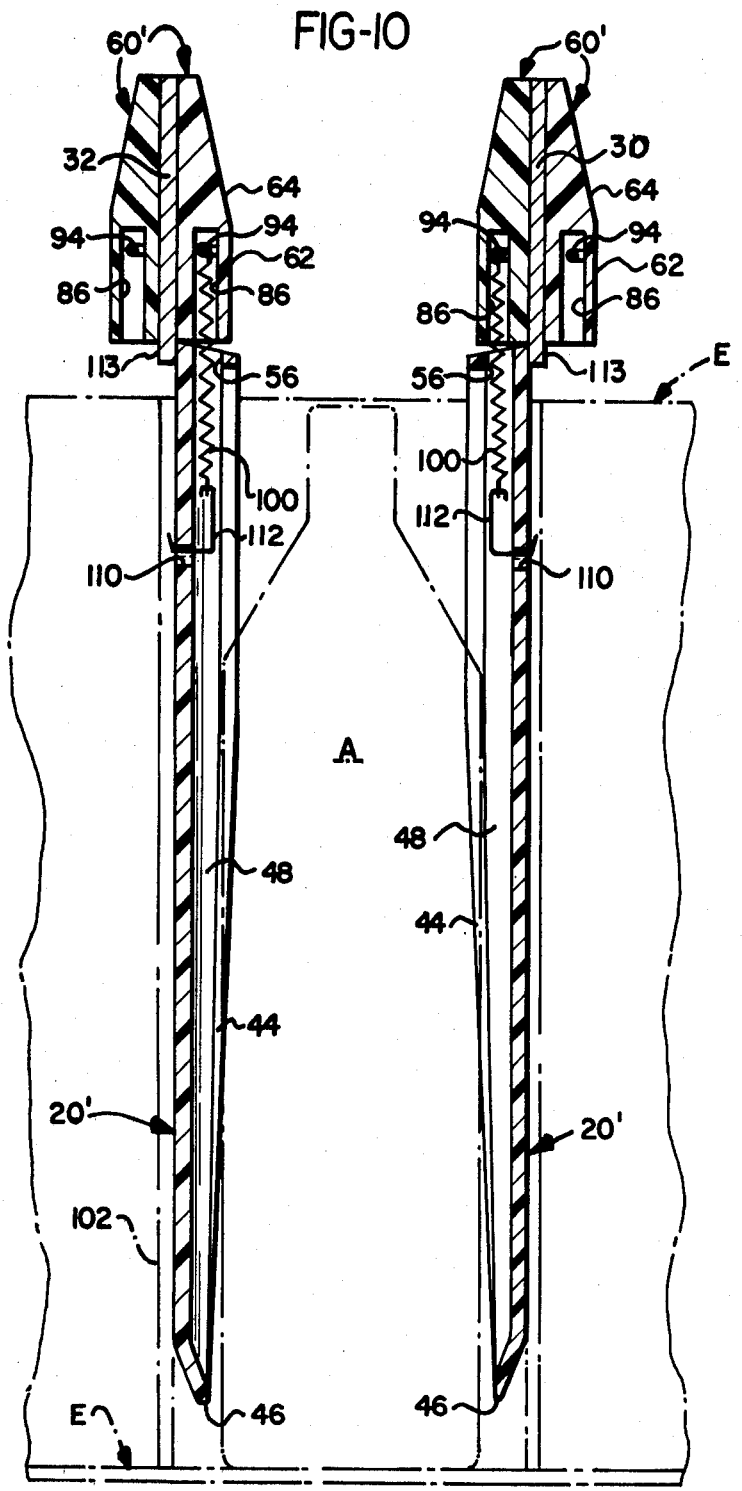
FIG. 10 is an elevation view of the section, as seen along line 10—10 of FIG. 9.

Referring now to FIGS. 8–10, therein illustrated is a second embodiment of the present invention. The second embodiment utilizes a guide member 20 identical to guide member 20 of the first embodiment, except that the rod 52 and apertures 50 therefor are replaced by a single aperture 110 extending from the front of the recess 48 through the intersection of the back surfaces 40, 42 of the guide member 20'. While, as suggested hereinabove, this arrangement allows the lower end of spring 100 to be directly secured to the guide members 20', preferably one employs an intermediate connecter 112 having a hooked upper end adapted to be secured to the lower end of the spring 100 and a hooked lower end adapted to be secured to the aperture 110. The intermediate connecter 112 enables a shorter spring 100 to be employed. It also enables the spring tension to be easily varied by using intermediate connectors 112 of differing lengths. Furthermore it enables use of guide members 20' of differing lengths (so that the apertures 110 are disposed at varying lengths from the bottom end of spring 100), the effective length of the spring 100 being varied as necessary for compensatory purposes by the use of intermediate connectors 112 of varying lengths. Thus conversion of one guide mechanism (perhaps adapted for use with large bottles) to a slightly modified guide mechanism (perhaps one adapted for use with small bottles) using different length guide members 20' is accomplished without any need for replacement of the springs 100.

In the second embodiment preparation of the support members 30, 32 is also simplified as the slots 92 of the first embodiment (through which pass rods 94) are no longer required. Elimination of the slots 92 in the support members 30, 32 is made possible by the use of a novel mounting member composed of two half-members 60'. Each half-member 60' has a configuration similar to that which would be achieved if (1) the slit 66 of the mounting member 60 of the first embodiment were extended downwardly all the way through the mounting member 60, (2) the ridges 80, 82 dividing the bottom of the mounting member 60 of the first embodiment into compartments 84 were eliminated, and (3) the small apertures 90 intended for receipt of the rods 94 were rotated about 90° so that there were small apertures 90' generally parallel to the slit 66 (rather than perpendicular thereto). It will be appreciated that as the small apertures 90' run parallel to the support member 30, 32 in the second embodiment, there is no need for slots 92. Of course while each small aperture 90' still passes through two cylindrical apertures 86, both of the cylindrical apertures 86 are now disposed on one side of the support member 30, 32 (rather than opposite sides thereof). While it is still possible for the cylindrical apertures 86 to be disposed so that they form the corners of a square intersecting the support member 30, 32 at right angles (as shown with respect to the first embodiment), this need may not be the case and, as shown, when both half-members 60' are in place on the support member 30, 32, they may form the corners of a rectangle which need not have sides perpendicular to the support members 30, 32.

The half members 60' are configured and dimensioned such that when they are secured to the support members 30, 32 by means of screws 76, the bottoms thereof are disposed a few millimeters above the bottom of the support member 30, 32 upon which they are mounted. This is an important feature of the second embodiment as it enables the protruding portion of the support member 30, 32 to function as a ridge 113 preventing the guide members 20' on the one side of the support member 30, 32 from sliding over against the guide members 20' on the opposite of the support member. While the absence of a ridge perpendicular to the effective ridge 113 formed by the support member 30, 32 does enable more rotation of the guide members 20' of the second embodiment than is permitted the guide members 20 of the first embodiment, it has been found that the extra limited range of play is of little consequence as rotation of one guide member 20' towards the other guide member 20' on the same side of the effective ridge 113 is essentially limited by the inability of the other guide member 20' to continue rotation in the same direction due its abutment against the effective ridge 113. Thus the use of the two half-members 60' in the second embodiment (instead of the single mounting member 60 of the first embodiment) enables the manufacturer to avoid machining operations on the support member (namely, the slots 92) and simplifies production of the half-members 60' by eliminating the need for slits 66 and ridges 80, 82. Furthermore, because of the absence of ridges 80, 82, a more compact mounting member is created, thus enabling the guide mechanism to be used with more closely spaced articles A.

Operation of the second embodiment is essentially identical to that of the first embodiment.

Figure 11:
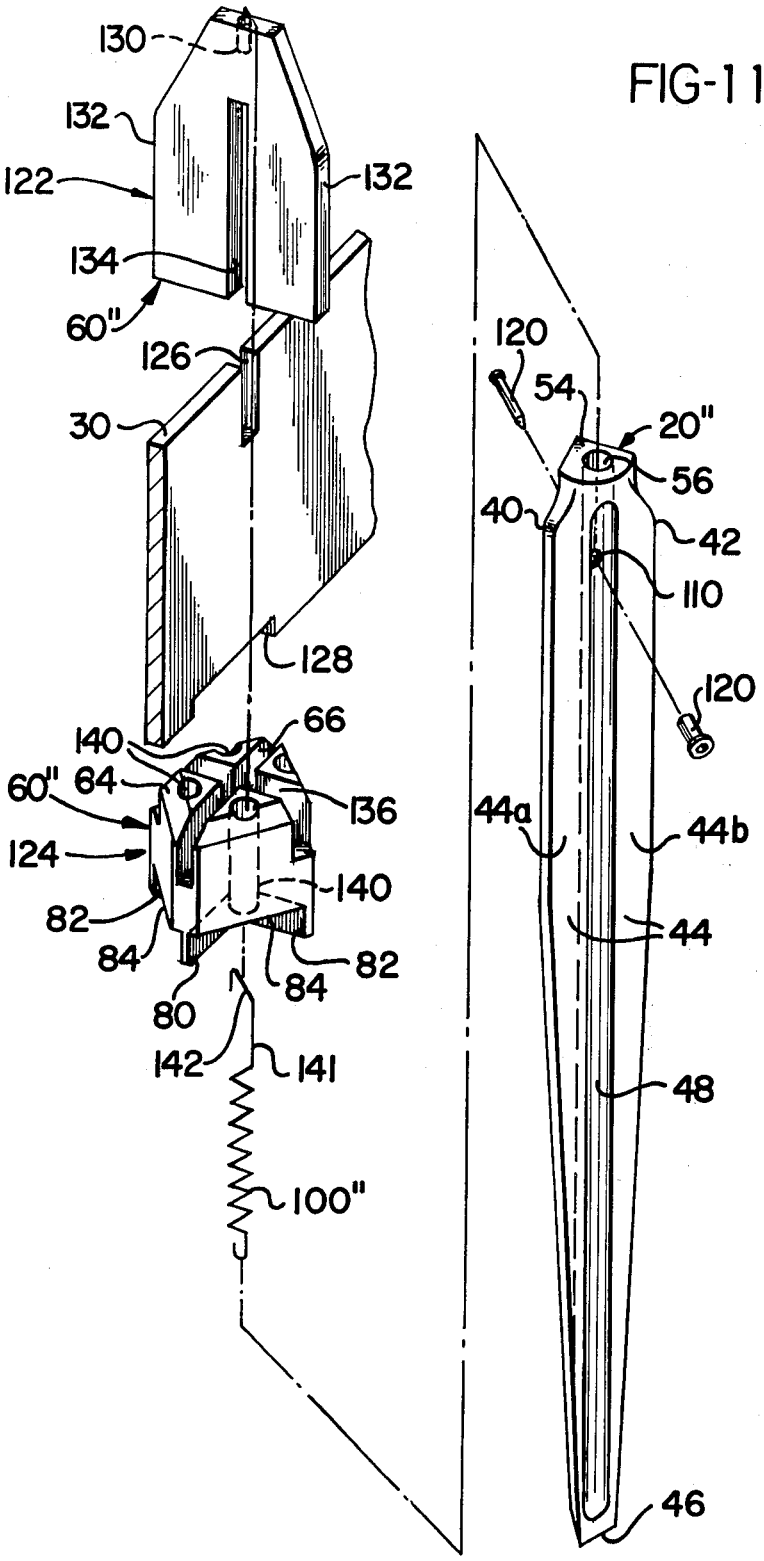
FIG. 11 is an exploded isometric view of a third embodiment of the guide mechanism.
Figure 12:
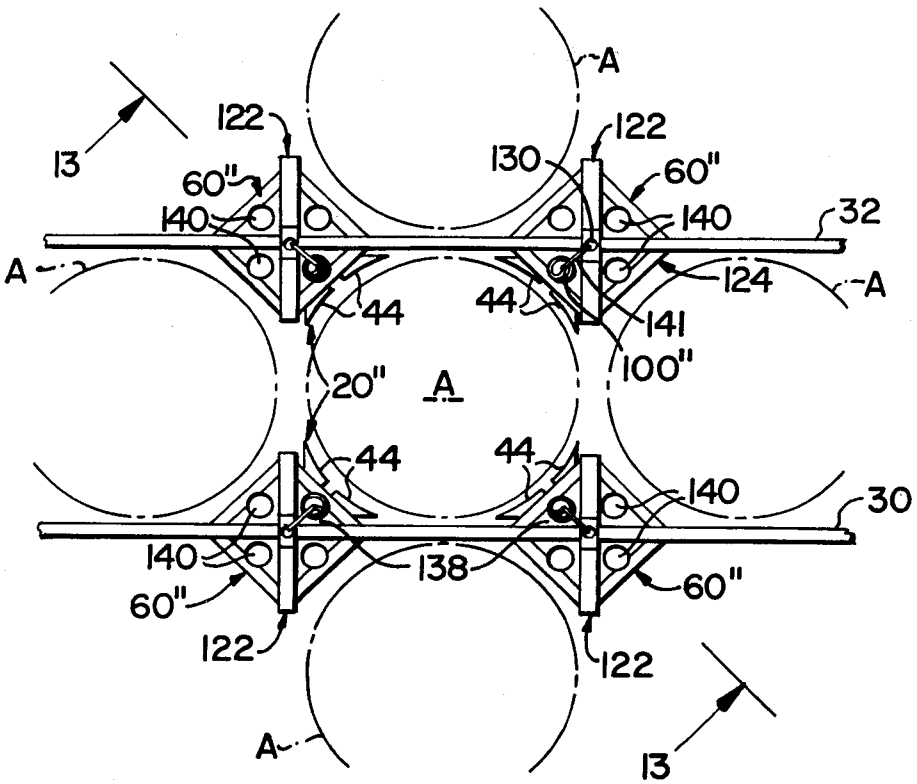
FIG. 12 is a top plan view of the third embodiment similar to that shown in FIGS. 6 and 9 and showing the guide members in their vertical or extended position.
Figure 13:
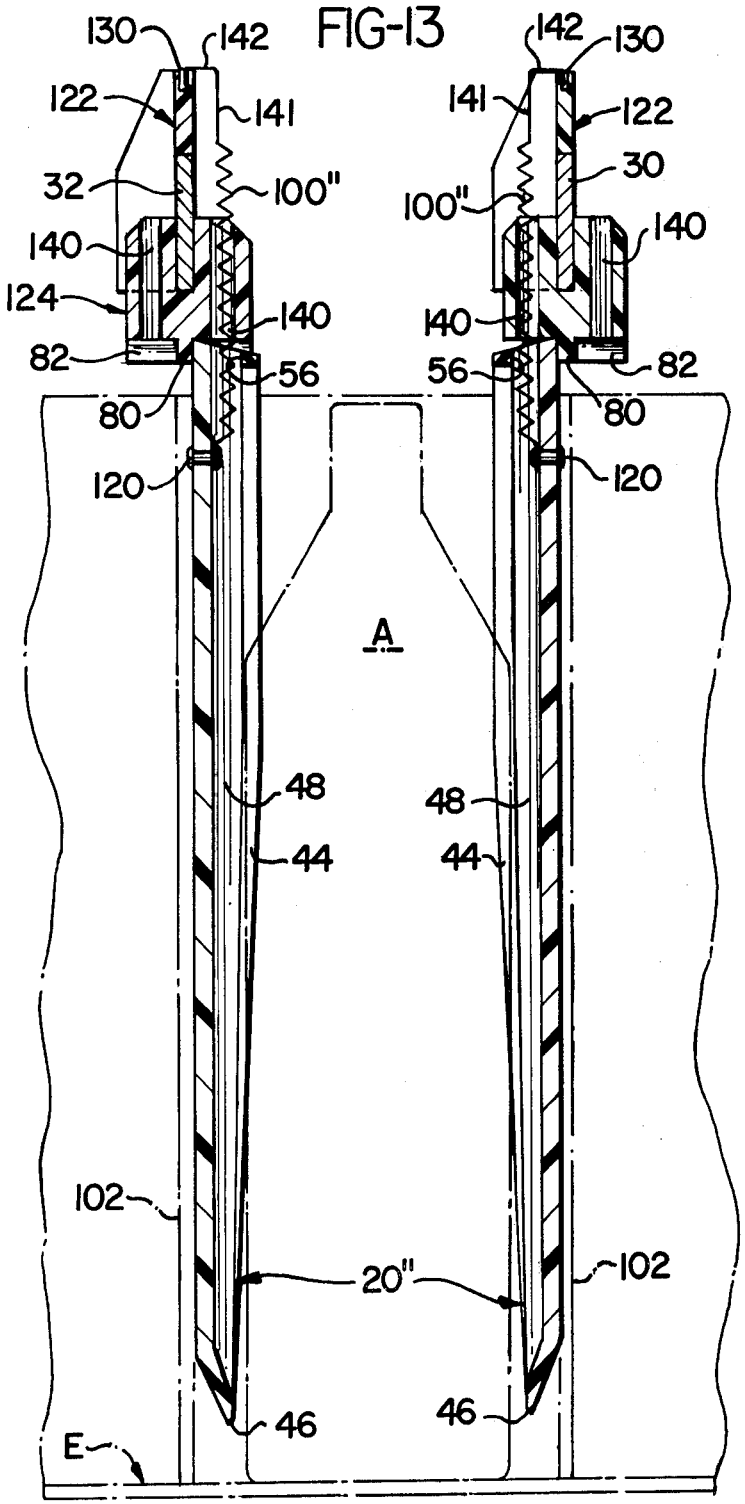
FIG. 13 is an elevation view of the section, as seen along lines 13—13 of FIG. 12.

Referring now to FIGS. 11–13, therein illustrated is a third embodiment of the present invention. The third embodiment utilizes a guide member 20'' identical to guide member 20' of the second embodiment, except that the spring 100'' is permanently secured by a pop rivet 120 or other conventional fastening means to the guide member 20'', the guide member 20'' and spring 100'' here comprising a subcombination for replacement purposes. The guide member and the spring may be separable through the use of tools so that one or the other component can be salvaged if the other is damaged, but this separation would probably be performed at a remote location from the operation site of the guide mechanism.

The mounting members 60'' of the third embodiment differ considerably from those of the first two embodiments, the latter being permanently affixed to the support members through the use of screws, bolts or the like requiring the use of tools for installation and the former being easily removably affixed to the support members without the use of tools and yet retained in the desired juxtaposition by means to be described hereinafter. Each of the mounting members 60'' comprises a keeper generally designated by the numeral 122 and a block generally designated by the numeral 124, the keepers 122 engaging upper portions of the support members 30, 32 and the blocks 122 engaging lower portions of the support members 30, 32 and defining the mounting member bottoms and compartments 84 of the first embodiment. For the purposes of the third embodiment, the support members 30, 32 require only one deep, narrow notch 126 at the top thereof for each keeper 122 and one shallow, broad notch 128 at the bottom thereof for each block 124, such top and bottom notches 126, 128 being configured and dimensioned to receive the keepers 122 and the blocks 124, respectively, and limit horizontal movement of each without the need for screws, bolts or the like as required by the first two embodiments.

The keeper 122 is relatively thin and has a shallow recess 130 at the top thereof. The sides 132 are substantially parallel, the upper portion thereof sloping outwardly from the recess-defining top to the parallel portion, the outward slope serving to deflect falling articles from the keeper 122 towards the appropriate passages. The bottom defines a deep slot 134 which engage the notch 126 at the top of the support member 30, 32. The keeper 122 preferably extends outwardly from the plane of the support member 30, 32 at least substantially as far as the block 124, thereby to deflect articles directed towards the top of the block 124 into the appropriate passages. The bottom of the block 124 is substantially similar to the bottom of the mounting member 60 of the first embodiment and includes ridges 80, 82 defining compartments 84. The top of the block 124 defines a pair of perpendicularly intersecting slots, one slot 66 being adapted to receive the notch 128 of the bottom portion of one of the support members 30,32 therein (as in the first embodiment) and the other slot 136 being adapted to receive the bottom of one of the keepers 124 therein. Typically the keeper-receiving slot 136 will be wider than the support member-receiving slot 66. Each block 124 further defines four generally vertically extending cylindrical apertures 140 therethrough, thereby enabling resilient means 100'' to extend from below the block, through the block, to above the block. Preferably the block slots 66, 136 grasp the support member 30, 32 and keeper 122, respectively, relatively snugly to facilitate the guide mechanism assembly process (when there is nothing maintaining the block in position) and to limit play of the various components during operation of the assembled guide mechanism.

The resilient means employed in the third embodiment is preferably a spring 100'' of considerably greater length than that employed in the other embodiments as it is not simply secured at one end within the mounting member 60 or 60', but must extend in the third embodiment to or adjacent to, the top of the keeper 122. As noted beforehand, the lower portion of the spring 100'' is, for all practical purposes, permanently secured to the guide member 120''. The spring 100'' then proceeds upwardly in a generally vertical fashion through the associated cylindrical aperture 110 in the block 124 and then extends upwardly, above the top of the block, substantially in a corner 138 defined jointly by a keeper 122 and a support member 30, 32. The upper portion of the spring is simply a straight length 141 of spring metal having a hook 142 at the top, the hook 142 being adapted to enter the recess 130 in the top of the keeper 122. It will be appreciated that the use of a straight length 141 at the upper end of the spring 100'' and the placement of that straight length 141 within such a corner 138 acts to protect the spring 100'' from being damaged by falling articles.

The spring 100'' operatively connects and maintains under compressive tension guide member 20'' and the keeper 122 thereby securing the keeper 122 to the upper portion of the support member 30, 32 and the block 124 to both the support member lower portion and the guide member top. Thus the springs 100'' extend from below to above the blocks 124 and operatively connect one of the guide members 20'' below and one of the keepers 122 above. Operatively disconnecting a spring 100'' from a keeper 122 enables disengagement of the guide member/spring subcombination 20''/100'' from the keepers 122, blocks 124, and support members 30, 32. Provided there are other springs connected to that keeper 122, the keeper 122, block 124, support member 30, 32 and guide member(s) 20'' associated with such keeper 122 will all be kept in appropriate juxtaposition. However once all of the springs 100'' normally associated with a given keeper 122 (typically four springs 100'') are operatively disconnected from such given keeper 122, it is possible without the use of tools to completely disengage from one another the given keeper 122 and all of the support member 30, 32, block 124 and guide members 20'' associated with that given keeper. Thus the springs 100'' act as the cohesive force keeping the various portions of the guide mechanism in appropriate juxtaposition. This features enables a rapid assembly or disassembly of a guide mechanism without the use of any tools other than a simple hook (typically made of piano wire) for placing/removing the upper end of the spring 100'' into/from the recess 130 at the top of the keeper 122.

Figure 14:
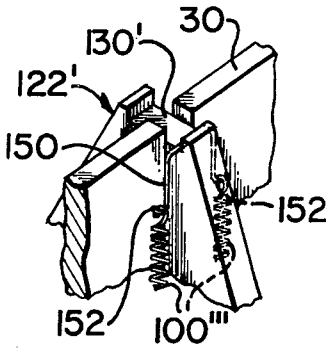
FIG. 14 is an isometric fragmentary view, taken from the top, of a modification of the third embodiment.

Referring now to FIG. 14, where a special spring 100'' having a straight end 141 with a hook 142 at the tip thereof is unavailable, one may employ a conventional spring 100''' (similar to that used in the first two embodiments, although of greater length), the upper end thereof terminating above the block 124 and below the top of the keeper 122. In this case the top of keeper 122' defines a recess 130' wide enough to extend to both sides of the support member 30, 32 and the guide mechanism additionally includes a generally U-shaped member 150 having a hook 152 at each end thereof, the U-shaped member 150 being mounted on the keeper recess 130'. The upper end of spring 100''' is then simply placed on a hook 152, one upper spring end to each hook. As there are generally four guide members 20'' associated with a given mounting member 60'' and there should be one hook end for each guide member 20'', typically there will be used two U-shaped members 150 per keeper 122, one on each side of the support number 30, 32. While normally the U-shaped member 150 would be subjected to balanced forces from the spring ends on each hook 152 thereof, it is preferably configured and dimensioned so that even if a spring 100''' is attached to only one hook 152 thereof (as might be the case for a mounting member 60'' secured to an end support member 26, 28 or a mounting member 60'' which is at the time undergoing replacement of a guide member/spring subcombination), the U-shaped member 150 will remain seated in the keeper recess 130'.

It will be appreciated that in each of the foregoing embodiments the resilient means employed to maintain connection and tension between a mounting member and its guide members have been extension coil springs, one spring being used per guide member. As will be appreciated by those skilled in the art, while extension coil springs are highly suitable as resilient means under normal packer operating conditions, once extensive trash glass breakage accumulates in the guide mechanism, it may cause an extensive wedging action imperilling future operation of the guide mechanism. The wedging action results from the trash glass breakage accumulating about the guide members and imparting a lateral movement to the guide members which kinks the extension coil spring and, in extreme cases, actually shears it, thereby depriving the guide member of any support whatsoever. Replacement of a spring 100 in the first and second embodiments is a rather difficult matter as the upper end thereof must be removed from, and a new spring upper end must be secured to, a rod 94 disposed within a rather small mounting member 60 or 60'. While replacement of a spring 100'' is somewhat easier in the third embodiment, there are still problems. Considering the rather close clearances to be found in many packers for small bottles, it is no easy matter to insert a spring 100'' upwardly through a cylindrical block aperture 140, from the appropriate hook 142 in the head of the spring, and then insert the hook into the keeper recess 130. Indeed this procedure is so arduous that it was frequently easier and faster to simply unhook all four springs 100'' from the keeper recess 130 and permit the entire mounting block 60'', its associated four guide members 20'' and its associated four springs 100'' to drop away, as a single replacement subcombination, and then to replace the same with a new but similarly constituted replacement subcombination. Then, at a convenient time at a place remote from the packer, the single defective spring 100'' and its associated guide member 20'' could be removed from the mounting block 60'' and a new spring/guide member combination inserted, thereby forming a new replacement subcombination.

Referring now to FIGS. 15–18, therein illustrates is a fourth embodiment of the present invention, which embodiment is less susceptible to damage to the resilient means, even in the presence of extensive trash glass breakage, and which embodiment enables faster on-line replacement of broken or damaged resilient means than was hitherto attainable. The advantages derive from replacement of the pair of springs 100, 100″ (or as illustrated in FIG. 14 the pair of springs 100‴ and a connecting U-shaped member 150) by a piece of resilient belting 160.

Figure 15:
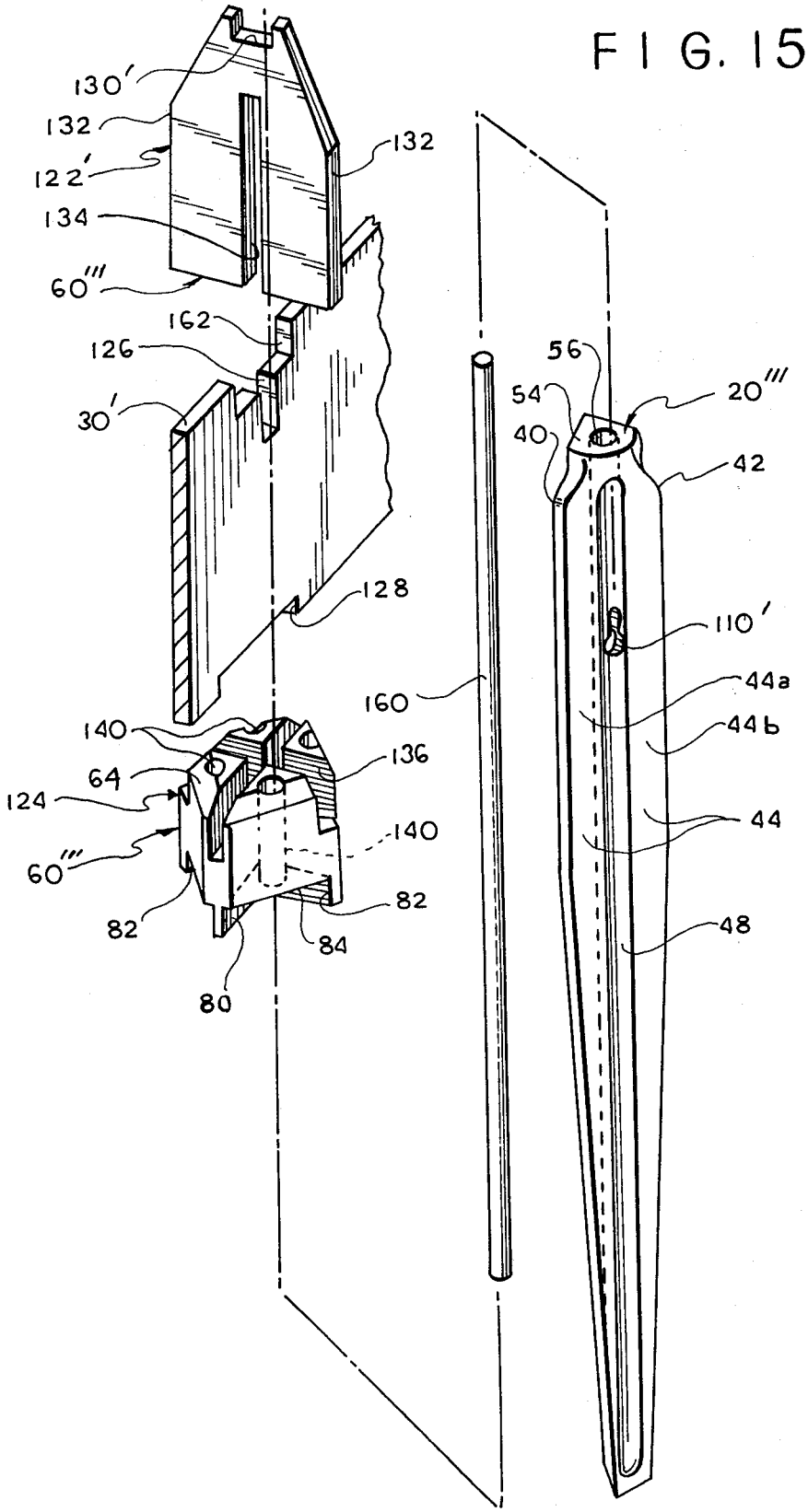
FIG. 15 is an exploded isometric view of a fourth embodiment of the guide mechanism.
Figure 18:
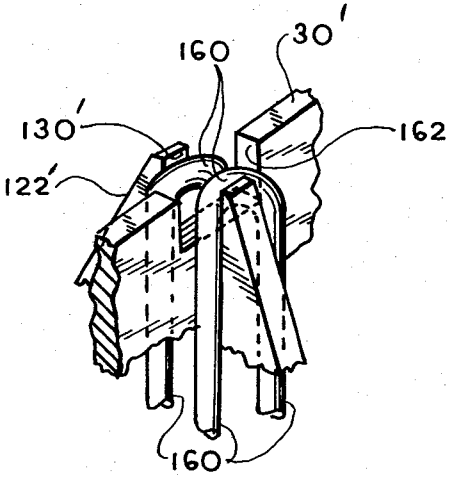
FIG. 18 is an isometric fragmentary view, taken from the top of the fourth embodiment.
Figure 16:
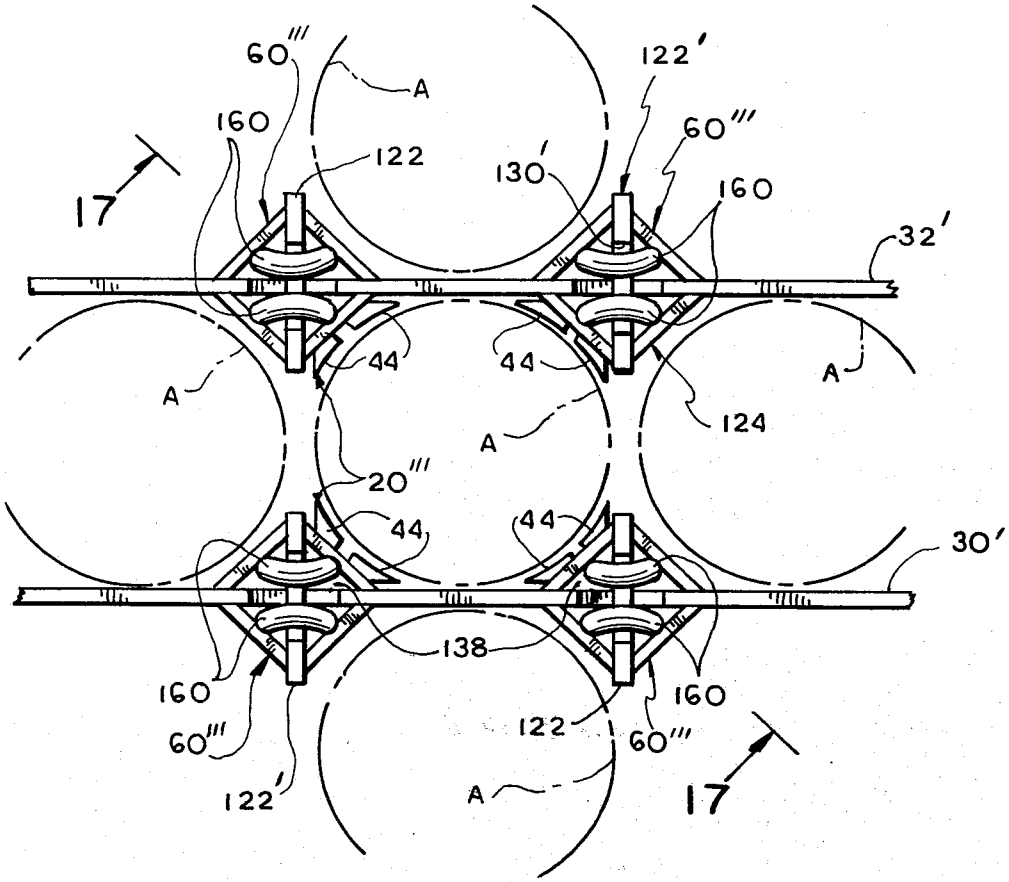
FIG. 16 is a top plan view of the fourth embodiment similar to that shown in FIGS. 6, 9 and 12 and showing the guide members in their vertical or extended position.
Figure 17:
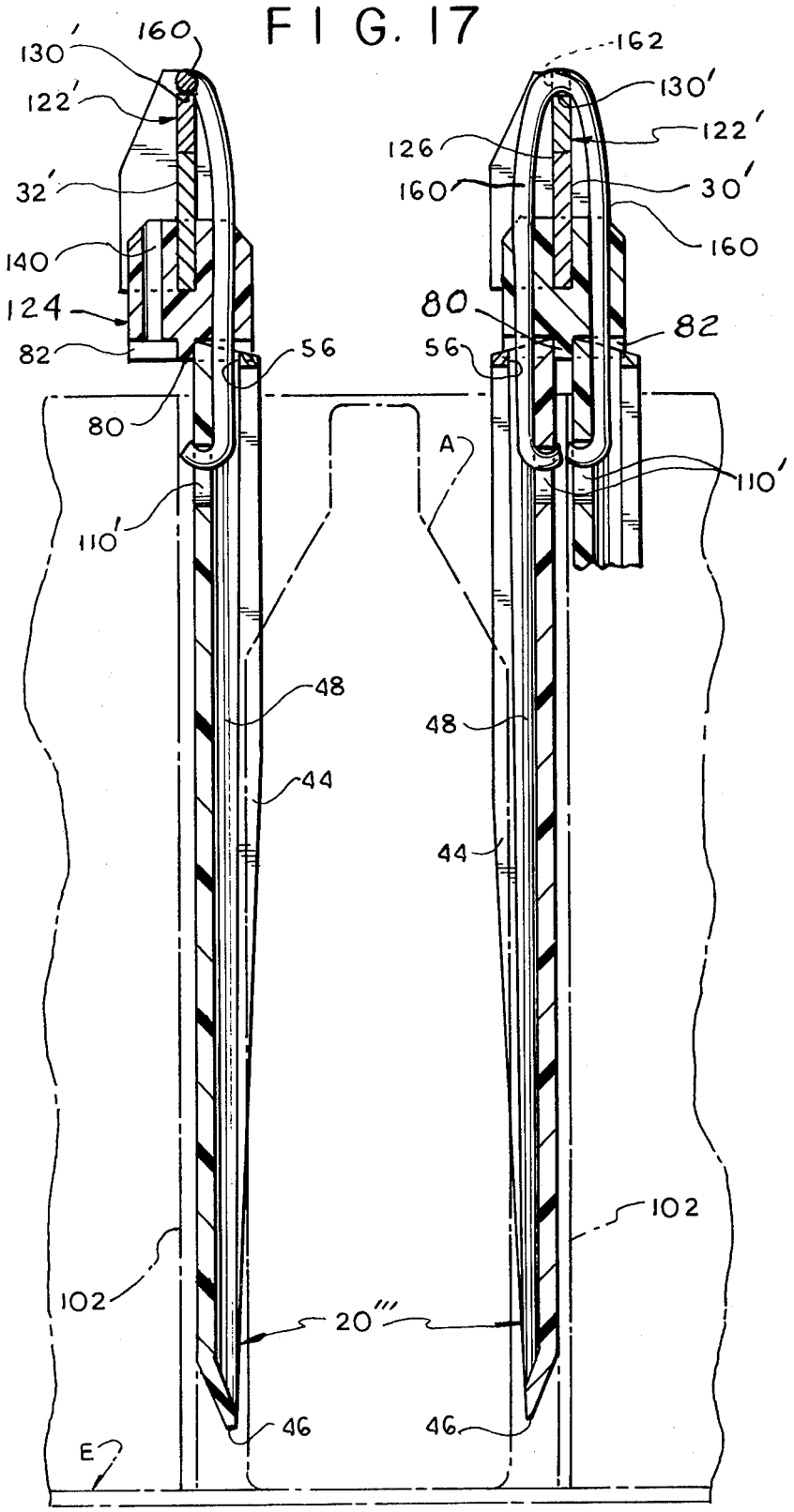
FIG. 17 is a fragmentary elevation view of the section, as seen along line 17—17 of FIG. 16.

Aside from this single structural substitution, the fourth embodiment is almost identical structurally to the third embodiment as illustrated in FIG. 14. The mounting member employed is a mounting member 60‴ as shown in FIG. 15, consisting of a mounting block 124 and a keeper 122′ (as shown in FIG. 14). The support members 30′, 32′ are similar to the support members 30, 32 of the third embodiment except that, in addition to the top notch 126, there is a more shallow, but substantially wider notch 162 thereabove. The guide member 20‴ is similar to the guide member 20″ of the third embodiment except that there is neither a fastening means 120 nor a spring 100″, and the aperture 110′ has the configuration of a keyhole slot, wide at the bottom and narrow at the top.

The previously mentioned resilient belting 160 is preferably formed of a plastic material having the appropriate resiliency, hardness and diameter. One such commercially available belting suitable for use in the present invention is a round polyurethane belting available from Eagle Belting (Des Plaines, Ill.) and having a diameter of 3/16″, a Durometer hardness of 85*, and a tensile strength of 5800 psi. Naturally the belting diameter must be suitable for the guide member recess 48 and aperture 110′ as well as the block aperture 140 and keeper recess 130′. For example, where the belting has a diameter of 12/64″, the wide bottom portion of the aperture 110′ may be about 13/64″ and the narrow top portion about 6/64″ in diameter. The belting should easily fit into the large bottom portion of the aperture and yet be tightly held in the small upper portion to lock same to the guide member. A round pointed tool, such as a nail, may be used, if necessary, to force the belting to slightly compress as it enters the narrow portion of the aperture.

*Shore A scale

The belting hardness should be sufficient to resist cutting by broken glass, and the modulus of elasticity should provide the necessary tension to maintain the guide member upper portion/mounting member bottom interface while still permitting the requisite freedom of movement to the guide member. The belting is more flexible laterally than a spring and less prone to kinking or shearing upon lateral displacement of a guide member from its mounting block.

In order to form the replacement subcombination unit for the fourth embodiment, the two end portions of a length of belting 160 are inserted downwardly into the mounting block 124, each end portion occupying a respective cylindrical aperture 140 on the same side of the block slot 66 (so that both block apertures 140 will be on the same side of the support member 30′, 32′ when the replacement subcombination is in place). A pair of guide members 20‴ to be associated with the particular piece of belting 160 are then put in place below the block 124, and each end portion of the belting is inserted into the large bottom portion of the aperture 110′ of its respective guide member. At this point the belting 160 is adjusted so that the bight portion thereof extending above the block 124 is just large enough so that it will be stretched an appropriate amount (usually 10–15%) when the replacement subcombination is in place with the bight portion stretched over the keeper recess 130′. Then the belting end portions are formed upwardly from the wide bottom portion of the apertures 110′ into the narrow top portions, using a round pointed tool to force the belting upwardly into the restricted area. Any excess of the belting end portions is then trimmed. The process is then repeated with an additional piece of belting 160 being inserted through the remaining two block apertures 140 and secured to another pair of guide members 20‴. This completes the replacement subcombination.

To use the replacement subcombination, the mounting block 124 thereof is simply brought into engagement with the support member 30′, 32′ and keeper 122′ in the customary fashion. Then a hook (e.g., a piece of piano wire with a circular finger grip at one end and a hook at the other end) is used to stretch the bight of one piece of belting 160 over the top of the keeper 122′ and allow it to fall into the keeper recess 130′. The procedure is then repeated with the other piece of belting 160, the wide, shallow notch 162 in the top of the support member 30′, 32′ providing sufficient room for the two pieces of belting 160 to fit within the keeper recess 130′. When it is desired to remove the replacement subcombination, the same hook is used to stretch first one, then the other, of the pieces of belting 160 out of the keeper recess 130′, thus enabling the replacement subcombination to be removed as a unit from the remainder of the guide mechanism. Once the replacement subcombination has been removed, the end portions of the belting 160 can be forced downwardly, from the narrow, into the wide portions of the guide member apertures 110′, thus enabling separation of the guide members 20‴ from the belting 160. Then the belting 160 can be removed from the block apertures 140 to leave the belting, block and fingers all separate.

As only two pieces of belting must be removed from and inserted into the keeper in the fourth embodiment, as opposed to the four springs 100″ in the third embodiment, replacements are faster and easier.

It will be understood that in FIGS. 4–7, 9–10, and 12–13, for clarity of illustration, there are shown only the guide members 20, 20′, 20″ which would be directly acting on an article A shown in the center of FIGS. 6, 9, and 12, respectively.

To summarize, the present invention provides a guide mechanism for a case packer or the like which not only reduces the guide member finger breakage by enabling the fingers essentially unlimited universal pivotal movement about the mounting structure (at least 90° in all lateral directions), but facilitates the repair and replacement of parts should the same be necessary, for example, by permitting a single finger or finger/resilient means or block/fingers/resilient means subcombination to be replaced without disassembly of other portions of the guide mechanism. The guide mechanism employs a rugged resilient means (e.g., a straight tension coil spring or belting), which will retain both resiliency and memory for a prolonged period of use, for two distinct purposes, first, to connect the guide member to the mounting structure and, second, to cooperate with the top of the guide member and the bottom of the mounting structure to bias the guide member to its normal or closed position. Furthermore, the resilient means is disposed closely adjacent the articles as they pass through the passage, yet is protected from damage thereby due to the disposition of the resilient means within a recess of the guide member. Additionally the resilient means enables a degree of downward motion of the guide member relative to the mounting member, this feature being especially desirable in clearing jams.

Now that the preferred embodiments of the present invention have been shown and described in detail, various modifications and improvement thereon will become readily apparent to those skilled in the art. Accordingly, the spirit and scope of the present invention is to be limited only by the appended claims, and not by the foregoing disclosure.

I claim:

1. In a guide mechanism for use in an article-loading machine having means for positioning articles in predetermined juxtaposition above said guide mechanism and means for positioning an article-receiving receptacle below said guide mechanism, said guide mechanism comprising a plurality of elongated support members defining a generally horizontal grid, and a plurality of mounting members spaced along said support members to define passages through which the articles pass downwardly into the receptacle; the improvement wherein said mounting members have bottom surfaces and said guide mechanism further comprises elongated downwardly-extending guide member fingers having top surfaces defining a fulcrum and spring means acting substantially vertically in tension to resiliently contact each finger with a respective mounting member to force pivotal engagement of the fulcrums on the top surfaces of said fingers against the bottom surfaces of said mounting members and to simultaneously hold said fingers in position below said mounting members; said finger top surfaces and fulcrums defined thereon, said bottom surfaces of the mounting members and said spring means cooperating so that the lower ends of said fingers normally are urged by said spring means to extend inwardly towards the centers of said passages for engaging articles before the articles are dropped through said passages and pivot outwardly towards the periphery of said passages against the action of said spring means as the articles pass through said passages into the receptacle.

2. The guide mechanism of claim 1 wherein said fingers are disposed adjacent the corners of said passages and connected to said mounting members only by said spring means.

3. The guide mechanism of claim 1 wherein each of said spring means comprises a coil expansion spring secured adjacent one end to one of said mounting members and adjacent the other end to one of said fingers, said spring extending substantially vertically prior to the dropping of articles into said passages.

4. The guide mechanism of claim 3 additionally including connector means adapted for connection at one end to said spring and at the other end to said fingers, thereby to secure said fingers to said mounting members and enable the effective length of said spring to be varied by use of an appropriately sized connector means without removal of said spring from said mounting member.

5. The guide mechanism of claim 4 wherein said spring is secured adjacent said other end to one of said fingers at a point appreciably spaced downwardly from the top of said one finger.

6. The guide mechanism of claim 1 wherein each of said mounting members includes on the lower surface thereof a plurality of downwardly extending ridges defining a plurality of separate and distinct bottom-defining compartments, said ridges limiting sliding of each of said fingers associated with a given one of said mounting members towards other of said fingers associated with the same one mounting member and rotation of said fingers, while enabling essentially unlimited universal pivotal movement of said fingers relative to the same mounting member.

7. The guide mechanism of claim 6 wherein the bottoms defined by said mounting member compartments are larger than the tops of said fingers.

8. The guide mechanism of claim 6 wherein said mounting members includes a pair of intersecting ridges to define four triangular compartments.

9. The guide mechanism of claim 8 wherein said spring means enter into said mounting members substantially through the centers of said compartments.

10. The guide mechanism of claim 1 wherein said spring means enter into said mounting members at a point substantially spaced from the edge of mounting member.

11. The guide mechanism of claim 1 wherein at least one of said mounting members comprises two half-members disposed on opposite sides of one of said support members, each said half-member having a lower surface disposed above the bottom of said one support member, whereby the lower surface of said one support member limits sliding of each of said fingers associated with one of said half members towards the fingers associated with the other of said half-members while enabling essentially unlimited universal pivotal movement of said fingers relative to said one mounting member.

12. The guide mechanism of claim 1 wherein the tops of said fingers, the bottoms of said mounting members or both are inclined at other than 90 degrees relative to the axis of said fingers, thereby to incline the lower ends of said fingers inwardly towards the centers of said passages.

13. The guide mechanism of claim 1 wherein each of said fingers define an axially extending recess exposed to an associated one of said passages and said spring means extends an appreciable length into said recess, whereby said recess protects said spring means from damage.

14. The guide mechanism of claim 13 wherein the top of said finger includes a surface defining an aperture leading to said recess and said spring means enters said recess via said aperture, whereby said aperture assists in maintaining said spring means within said recess.

15. The guide mechanism of claim 1 wherein said finger tops, mounting member bottoms and spring means are configured and dimensioned to permit essentially unlimited universal pivoting of said fingers relative to said mounting members.

16. The guide mechanism of claim 1 wherein each of said mounting members comprises a keeper and a block, said keepers engaging upper portions of said support members and said blocks engaging lower portions of said support members and defining said mounting member bottoms; each of said spring means extending from below to above said blocks and operatively connecting one of said fingers below and one of said keepers above, whereby operatively disconnecting said spring means associated with said one finger from said one keeper enables disengagement of said one finger from said keepers, said blocks and said support members.

17. The guide mechanism of claim 16 wherein each of said spring means is permanently secured adjacent one end thereof to a respective associated one of said fingers, whereby said spring means and said associated one finger comprise a subcombination replacement unit.

18. The guide mechanism of claim 16 wherein each of said spring means has one end thereof adapted to removably engage an associated one of said keepers.

19. The guide mechanism of claim 16 additionally including a generally U-shaped member having a hook at each end thereof, said U-shaped member being mounted on said keeper with said hooks engaging two of said spring means respectively.

20. The guide mechanism of claim 16 wherein upper portions of said spring means are disposed above the tops of said blocks substantially in corners defined jointly by said keepers and said support members.

21. The guide mechanism of claim 16 wherein said spring means operatively connect said keepers and said fingers under tension, and thereby also secure said keepers to said support member upper portions of said blocks to both said support member lower portions and said finger tops.

22. The guide mechanism of claim 16 wherein said spring means normally maintains said fingers, keepers, blocks and support members together, and operative disconnection of all of said spring means from a given one of said keepers enables disengagement from one another of said given keeper and all of said support members, said blocks and said fingers associated with said given keeper.

23. The guide mechanism of claim 16 wherein said blocks define generally vertically extending apertures therethrough and said spring means extend through said block apertures.

24. The guide mechanism of claim 16 wherein said support members define notches at the top and bottom thereof, said top and bottom notches being adapted to receive said keepers and said blocks, respectively, and limit horizontal movement of each.

25. The guide mechanism of claim 16 wherein the top of said block defines a pair of intersecting slots, one of said slots receiving a bottom portion of one of said support members therein and the other of said slots receiving a bottom portion of one of said keepers therein.

26. The guide mechanism of claim 16 wherein said keepers extend outwardly from the plane of said support members at least substantially as far as said blocks, thereby to deflect falling articles from the tops of said blocks.

27. The guide mechanism of claim 1 wherein each of said mounting members comprises a keeper and a block, said keepers engaging upper portions of said support members and said blocks engaging lower portions of said support members and defining said mounting member bottoms; each of said spring means extending from below to above said blocks and operatively connecting an associated pair of said fingers below and an associated one of said keepers above.

28. The guide mechanism of claim 27 wherein said spring means comprises a resilient belting having end portions thereof extending through an associated block and secured to said associated pair of fingers and a bight portion intermediate said end portions stretched over said keeper.

29. The guide mechanism of claim 27 wherein each of said spring means passes through a respective block, is removably connected to a respective given keeper thereabove and is secured to at least two of the fingers associated with said given keeper therebelow, whereby operatively disconnecting all of said spring means secured to said given keeper from said given keeper enables disengagement of said respective block, said spring means and said fingers associated with said given keeper, as a subcombination replacement unit, from said given keeper and said support members.

30. The guide mechanism of claim 27 wherein said spring means has opposite end portions secured to different fingers, said end portions being operatively disconnectable from said fingers and capable of passing through said associated block, thereby to enable disengagement from each other of said associated block, said fingers, and said spring means.

31. The guide mechanism of claim 27 wherein upper portions of said spring means are disposed above the tops of said blocks substantially in corners defined jointly by said keepers and said support members.

32. The guide mechanism of claim 27 wherein said spring means operatively connect said keepers and said fingers under tension, and thereby also secure said keepers to said support member upper portions and said blocks to both said support member lower portions and said finger tops.

33. The guide mechanism of claim 27 wherein said spring means normally maintains said fingers, keepers, blocks and support members together, and operative disconnection of all of said spring means associated with a given one of said keepers from its associated fingers enables disengagement from one another of said given keeper and all of said support members, said blocks and said fingers associated with said given keeper.

34. The guide mechanism of claim 27 wherein said blocks define at least a pair of generally vertically extending apertures therethrough and each of said spring means extends through an associated pair of said block apertures.

35. The guide mechanism of claim 27 wherein said support members define notches at the top and bottom thereof, said top and bottom notches being adapted to receive said keepers and said blocks, respectively, and limit horizontal movement of each.

36. The guide mechanism of claim 27 wherein the top of said block defines a pair of intersecting slots, one of said slots receiving a bottom portion of one of said support members therein and the other of said slots receiving a bottom portion of one of said keepers therein.

37. The guide mechanism of claim 27 wherein said keepers extend outwardly from the plane of said support members at least substantially as far as said blocks, thereby to deflect falling articles from the tops of said blocks.

38. The guide mechanism of claim 1 wherein each of said mounting members comprises a keeper and a block, said keepers engaging upper portions of said support members and said blocks engaging lower portions of said support members and defining said mounting member bottoms; each of said spring means extending from below to above said blocks and operatively connecting at least one of said fingers below and one of said keepers above.

39. The guide mechanism of claim 38 wherein said blocks engage said support member lower portions in such a manner that operatively disconnecting all of said spring means associated with a given one of said keepers from said given keeper enables disengagement of said block associated with said given keeper from its support member lower portion.

40. A guide member for use in a guide mechanism on an article loading machine, wherein articles are loaded from predetermined juxtaposition above said guide mechanism into a receptable below said guide mechanism, said guide mechanism including (i) a plurality of elongated support members defining a generally horizontal grid, (ii) a plurality of mounting members spaced along said elongated members to define passages through which the articles pass downwardly into the receptacle, said mounting members having bottom surfaces, and (iii) spring means secured to said mounting members; said guide member comprising an elongated finger having a top surface defining a fulcrum and having an aperture at the top surface and a generally axially extending recess operatively connecting with and extending generally downwardly from said aperture, and means to said finger for securing said spring means to said finger at a point substantially spaced below said aperture, said spring means being adapted to be connected in tension to one of said mounting members so as to act substantially vertically to resiliently connect each finger with said one mounting member to force pivotal engagement of said fulcrum against the bottom surface of said one mounting member and to simultaneously hold said finger in position below said one mounting member so that said finger extends downwardly and to cause the lower end of said finger to extend inwardly toward the center of one of said passages for engaging an article before the article is dropped through said one passage into the receptacle, said finger pivoting about said fulcrum outwardly towards the periphery of said one passage against the action of said spring means as the article passes through said passage into the receptacle.

41. The guide member of claim 40 wherein said securing means comprises an aperture extending from said recess at the front of said finger through the back of said finger.

42. The guide member of claim 40 wherein said securing means comprises connector means adapted to be secured adjacent the top thereof to said spring means and adjacent the bottom thereof to said finger.

43. The guide member of claim 40 wherein said securing means comprises a keyhole slot having a wide portion to receive easily said spring means and a narrow portion to hold securely said spring means.

44. The guide member of claim 40 wherein said recess is configured and dimensioned to receive therein a substantial portion of the cross-section of said spring means.

45. A guide member for use in a guide mechanism on an article loading machine, wherein articles are loaded from predetermined juxtaposition above said guide mechanism into a receptacle below said guide mechanism, said guide mechanism including (i) a plurality of elongated support members defining a generally horizontal grid, and (ii) a plurality of mounting members spaced along said elongated members to define passages through which the articles pass downwardly into the receptacle and wherein each of said mounting members has a bottom surface;

said guide member comprising an elongated finger having a top surface defining a fulcrum and having an aperture opening to said top surface and a generally axially extending recess operatively communicating with and extending generally downwardly from said aperture, spring means at least partially disposed within said recess and adapted to be secured to one of said mounting members, and means securing said spring means to said finger at a point substantially spaced below said aperture, said spring means being adapted to be operatively connected in tension to said one mounting member so as to act substantially vertically to resiliently connect each finger with said one mounting member to force pivotal engagement of said fulcrum against the bottom surface of said one mounting member and to simultaneously hold said finger in position below said mounting member so that said finger extends downwardly and to cause the lower end of said finger to extend inwardly toward the center of one of said passages for engaging an article before the article is dropped through said one passage into the receptacle, said finger pivoting about said fulcrum outwardly towards the periphery of said passage against the action of said spring means as the article passes through said passage into the receptacle.

46. The guide member of claim 45 wherein said mounting member comprises a keeper and a block, said keepers engaging upper portions of said support members and said blocks engaging lower portions of said support member, said blocks having generally vertically extending apertures therethrough, said spring means being configured and dimensioned to enable passage thereof through at least one of said block apertures and operative connection thereof to one of said keepers, said spring means thereby acting to maintain at least one finger and its associated block, keeper and support member in appropriate juxtaposition.

* * * * *